US007063417B2

(12) United States Patent
Iwakura et al.

(10) Patent No.: US 7,063,417 B2
(45) Date of Patent: Jun. 20, 2006

(54) RECORDING APPARATUS AND RECORDING MEDIUM CONVEYING APPARATUS

(75) Inventors: Koya Iwakura, Kanagawa (JP); Tetsuyo Ohashi, Kanagawa (JP); Masahiro Taniguro, Kanagawa (JP); Junichi Yoshikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/928,169

(22) Filed: Aug. 30, 2004

(65) Prior Publication Data

US 2005/0046686 A1 Mar. 3, 2005

(30) Foreign Application Priority Data

Aug. 29, 2003 (JP) ..... 2003-306416

(51) Int. Cl.
*B65H 29/00* (2006.01)

(52) U.S. Cl. ..... 347/104; 271/186; 271/272

(58) Field of Classification Search ..... 271/186, 271/272, 274; 347/104
See application file for complete search history.

(56) References Cited

U.S. PATENT DOCUMENTS 4,579,326 A * 4/1986 Pinckney et al. ..... 271/3.03
5,580,042 A 12/1996 Taniguro et al. ..... 271/274
5,620,174 A 4/1997 Taniguro et al. ..... 271/10.12
5,672,019 A 9/1997 Hiramatsu et al. ..... 400/624
5,725,319 A 3/1998 Saito et al. ..... 400/629
5,836,706 A * 11/1998 Ruhe ..... 400/636
6,168,270 B1 1/2001 Saikawa et al. ..... 347/104
6,290,410 B1 * 9/2001 Sunada et al. ..... 400/624
6,332,068 B1 12/2001 Blackman et al. ..... 399/364
6,793,425 B1 9/2004 Yoshikawa et al. ..... 400/624

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A recording apparatus capable of preventing a recording medium from contacting a recording unit and causing a jam thereof on conveying is provided.

The recording apparatus of the present invention has a paper feed roller placed further upstream in a conveying direction in a normal conveying direction of the recording medium than a record head for recording on recording paper and a sheet inverting portion for inverting the recording paper like a loop and feeding it to the paper feed roller. The recording apparatus is constituted to stand by, for a predetermined time, for the conveying of the recording paper in a state in which a leading end of a backside of the recording paper in the normal conveying direction is in the sheet inverting portion in the process of inverting the recording paper in the sheet inverting portion.

12 Claims, 25 Drawing Sheets

RECORDING APPARATUS AND RECORDING MEDIUM CONVEYING APPARATUS

BACKGROUND OF THE INVENTION

1. Field of the Invention

The present invention relates to a recording apparatus and a recording medium conveying apparatus, and in particular, to the recording apparatus and recording medium conveying apparatus for recording on a front face (or front side surface) of a recording medium and then turning over the recording medium to record on backside (or rear side surface) thereof.

2. Description of the Related Art

Some proposals have been made so far as to an ink-jet apparatus capable of automatically performing two-sided recording. As for the apparatus disclosed by U.S. Pat. No. 6,332,068, recording paper is conveyed in a reverse direction by a paper feed roller after recording on a right face thereof, and is conveyed on an inverting route by a conveying roller in an inverting mechanism to which a driving force is transmitted from an LF motor for driving the paper feed roller. After a back end of the front face of the recording paper gets off the paper feed roller while conveying the recording paper on the inverting route, the paper feed roller rotates in a normal direction and conveys the recording paper in the normal direction to record on a backside thereof. In this case, the conveying roller in the inverting mechanism constantly rotates in the same direction whether the paper feed roller rotates in the normal direction or in the reverse direction. Therefore, even if the conveying roller rotates in the reverse direction while conveying the recording paper on the inverting route, the recording paper is conveyed in the same direction.

As for this recording apparatus, no measures are taken against floating of the end of the recording paper when recording on its backside. And it cannot record on a recording medium of high rigidity which cannot curve. A pinch roller press-contacted to the paper feed roller cannot be separated. And it does not perform so-called registration for rendering the end of the recording paper parallel with the paper feed roller as to the recording paper after a reversal.

In the case of a two-sided recording operation using the inverting mechanism as described above, it may happen that, when high-concentration recording is performed on a platen, a certain time for drying a recording portion on the front face is given, and the recording paper is reversed to record on its backside by conveying the end of the backside on the platen; the recording paper curls upward due to ink landed on in it in front face recording so that the recording paper contacts a carriage or a paper jam thereof occurs in an ejection roller portion. The paper may curl and the jam may occur on the front face recording depending on conditions such as a kind of the recording paper, a temperature of an environment in which the recording operation is performed and a gas flow rate.

If a discharger rate of the ink to the recording paper on the front face recording is reduced in order to curb the floating of the recording paper on backside recording, a recording quality level of the backside deteriorates.

If a paper holding member is mounted on the platen to hold the front and back of the recording paper for the sake of keeping the recording paper from floating when recording on its backside, the paper holding member interferes with frameless recording so that the frameless recording becomes no longer feasible or takes a conspicuously longer time.

To curb the floating of the backside of the recording paper in the above configuration, it is necessary to curl the end of the recording paper downward (direction of the platen) before the end of the recording paper is conveyedconveyed on the platen when recording on its backside. To curl the end of the recording paper downward easily, it is desirable to hold the recording paper at points as close to its end as possible in a conveying route curved as much as possible.

In the case where the recording paper is thick paper of which stiffness is relatively high such as a postcard, however, the recording paper is curled only a little when recording on its right face so that it is not essential to curl the end of the recording paper downward when recording on its backside.

As long as recording on the front face is performed in a portion at some distance from the back end of the front face (equivalent to the end of the backside) of the recording paper, there is not much influence of curling the end of the recording paper on the backside, it is not essential to curl the end of the recording paper downward when recording on its backside.

In recent years, there have been growing needs of recording on recording media of high rigidity such as a CD (Compact Disk) and a DVD (Digital Versatile Disk) by using the recording apparatus. However, there has been no proposal so far as to the recording apparatus equipped with the inverting mechanism for the two-sided recording and capable of recording on the recording media of such high rigidity not invertible by the inverting mechanism such as the CD and DVD. It can be pointed out, as one of the reasons for this, that placement of the conveying roller in the inverting mechanism and an approximately horizontal path for conveying the recording media of high rigidity is difficult.

If the end of the recording paper on which the recording is performed is curled toward the carriage, the recording paper rasps (or rubs) against the carriage and the recording medium loaded thereon. Then, it creates a situation in which the paper jam occurs while conveying the recording paper, the recording paper is stained by recording means or the recording paper rasps and damages the recording means.

The recording paper inverted by the inverting mechanism is conveyed on the conveying route for inversion, and so it is obliquely conveyed if there is resistance on the conveying route or variation in conveying force between the right and left conveying rollers. If so, the recording on the backside of the recording paper is obliquely performed to the recording paper.

SUMMARY OF THE INVENTION

An object of the present invention is to provide a recording apparatus capable of preventing a recording medium from curling upward and contacting recording means and preventing the recording medium from causing a paper jam due to ink.

Another object of the present invention is to provide the recording apparatus for recording on a recording sheet with a record head, comprising a conveying portion for conveying the recording sheet and a sheet inverting portion for inverting the recording sheet, wherein, on inverting the recording sheet having recording performed on its first face with the sheet inverting portion, conveying of the recording sheet is stopped at a position where a leading end of the recording sheet is in the sheet inverting portion.

DETAILED DESCRIPTION OF THE PREFERRED EMBODIMENTS

Next, embodiments of the present invention will be described by referring to drawings.

Figure 1:
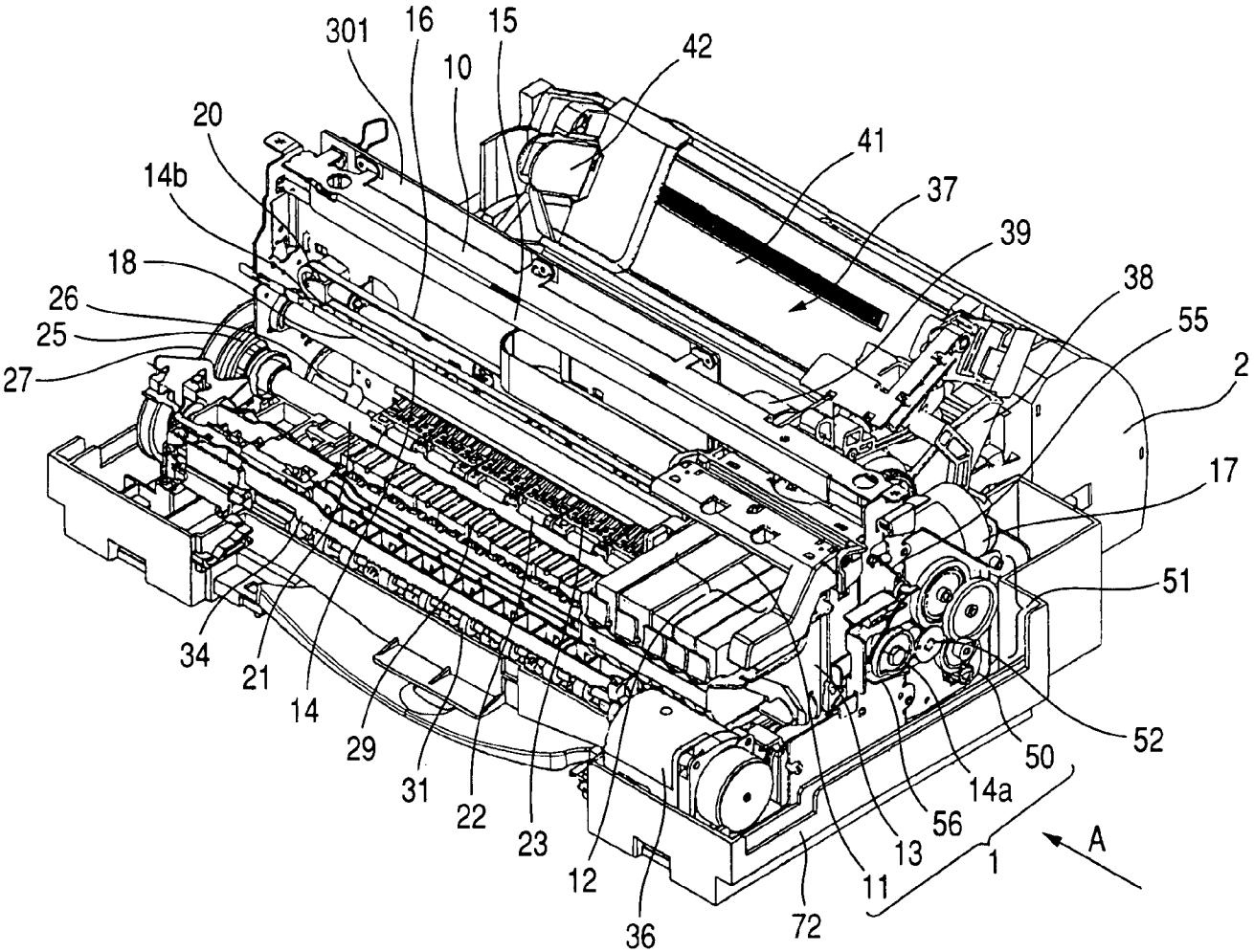
FIG. 1 is a schematic perspective view showing an overall configuration of a recording apparatus to which the present invention is applied.

FIG. 1 is a schematic perspective view showing an overall configuration of a recording apparatus to which the present invention is applied. And FIG. 2 is a schematic side sectional view showing the overall configuration of the recording apparatus viewed from an arrow A direction in FIG. 1.

Figure 2:
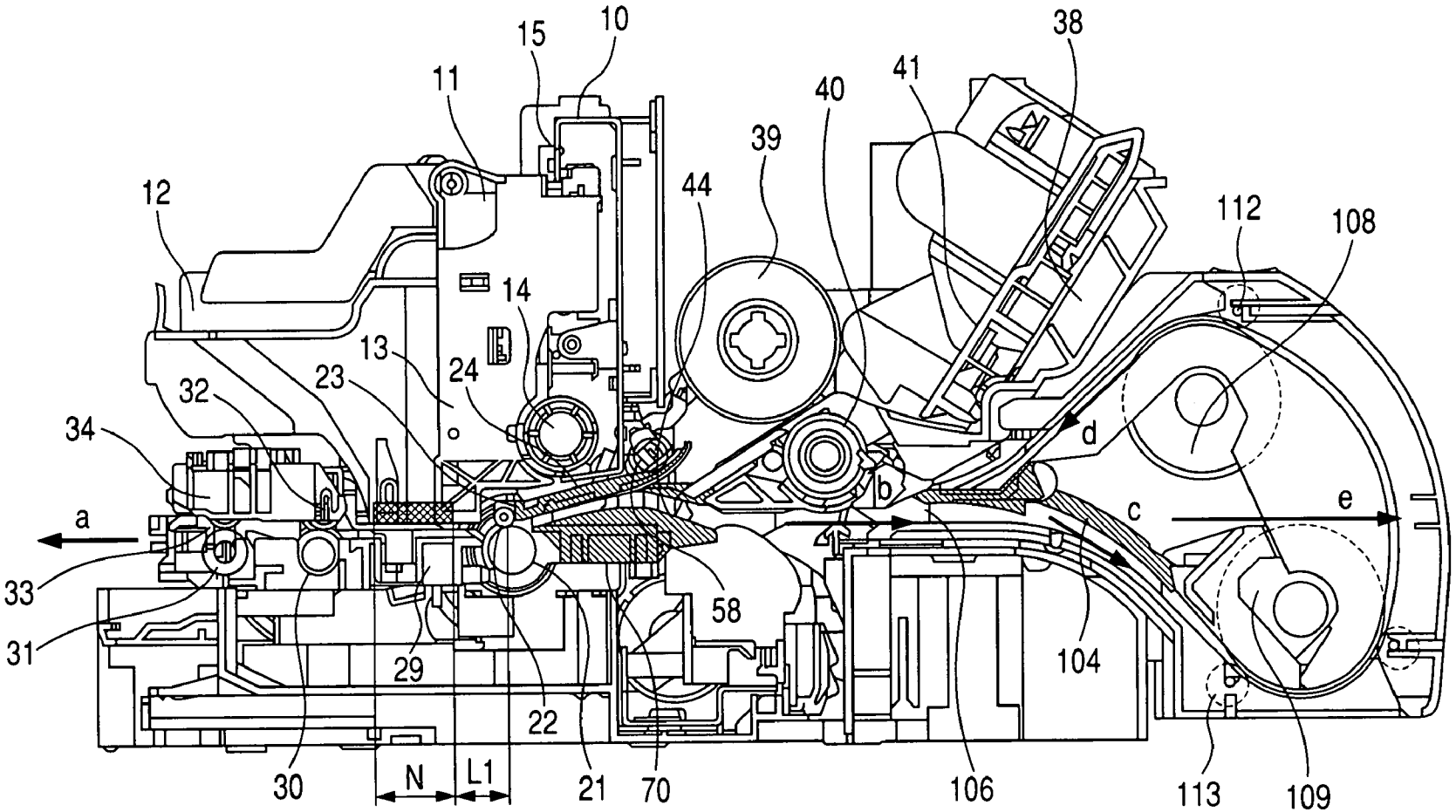
FIG. 2 is a schematic side sectional view showing the overall configuration of the recording apparatus viewed from an arrow A direction in FIG. 1.

As shown in FIGS. 1 and 2, the recording apparatus according to this embodiment has a recording unit body 1, a sheet inverting portion 2, a chassis 10 for supporting a structure of the recording unit body 1, a carriage 13 for holding a record head 11 for discharging ink and recording and an ink tank 12 for storing the ink to be supplied to the record head 11 so as to scan in a direction (main scan direction) intersecting with a conveying direction (sub scan direction) of recording paper, a guide shaft 14 for supporting the carriage 13, a guide rail 15 for supporting the carriage 13 in parallel with the guide shaft 14, a carriage belt 16 for driving the carriage 13, a carriage motor 17 for driving the carriage belt 16 via a pulley, a code strip 18 for detecting a position of the carriage 13, and an idle pulley 20 for setting up the carriage belt 16 opposite the pulley of the carriage motor 17.

Furthermore, the recording apparatus has a paper feed roller 21 for conveying the recording paper, a pinch roller 22 to be pushed and driven by the paper feed roller 21, a pinch roller holder 23 for rotatably holding the pinch roller 22, a pinch roller spring 24 for press-contacting the pinch roller 22 to the paper feed roller 21, a paper feed roller pulley 25 fixed on the paper feed roller 21, an LF motor 26 for driving the paper feed roller 21, a code wheel 27 for detecting a rotation angle of the paper feed roller 21, a platen 29 placed opposite the record head 11 for supporting the recording paper, a first ejection roller 30 for conveying the recording paper in cooperation with the paper feed roller 21, a second ejection roller 31 provided on a downstream side of the first ejection roller 30, a first spur row 32 opposed to the first ejection roller 30 for holding the recording paper, a second spur row 33 opposed to the second ejection roller 31 for holding the recording paper, a spur base 34 for rotatably holding the first spur row 32 and second spur row 33.

Furthermore, the recording apparatus has a maintenance unit 36 to be used to prevent clogging by absorbing the ink from a nozzle of the record head 11 and to eliminate bubbles and so on in a flow path of the record head 11 on replacing the ink tank 12 by absorbing the ink from the nozzle of the record head 11, a main ASF (Automatic Sheet Feeder) 37 for loading the recording paper and supplying it to the recording apparatus sheet by sheet, an ASF base 38 to be a base of the main ASF 37, a paper feed roller 39 for contacting and conveying the recording paper loaded on the main ASF 37, a separation roller 40 for separating sheet by sheet a plurality of the recording paper conveyed at once, a pressure-plate 41 for loading the recording paper and energizing (or biasing) it in a direction of the paper feed roller 39, a side guide 42 provided on the pressure-plate 41 and fixable at width of any recording paper, a return nail (not shown) for returning the end of the recording paper having advanced ahead of a nip portion between the paper feed roller 39 and separation roller 40 to a predetermined position on a feed operation, and an ASF flap 44 for restricting a passing direction of the recording paper from the main ASF 37 as one direction.

Furthermore, the recording apparatus has a lift input gear 50 for engaging with an ASF planet gear 49 (FIG. 10), a lift deceleration gear row 51 for decelerating and transmitting power from the lift input gear 50, a lift cam gear 52 directly linked to a lift camshaft 58, a guide shaft spring 55 for one-sidedly energizing the guide shaft 14, a guide incline 56 for having a cam of a guide shaft gear (not shown) slide thereon, the lift camshaft 58 for lifting the pinch roller holder 23 and so on, a passing guide 70 for guiding the end of the recording paper to the nip portion between the paper feed roller 21 and pinch roller 22, a base 72 for supporting the entire recording unit body 1, and a control board 301 constituting a control portion.

Figure 3:
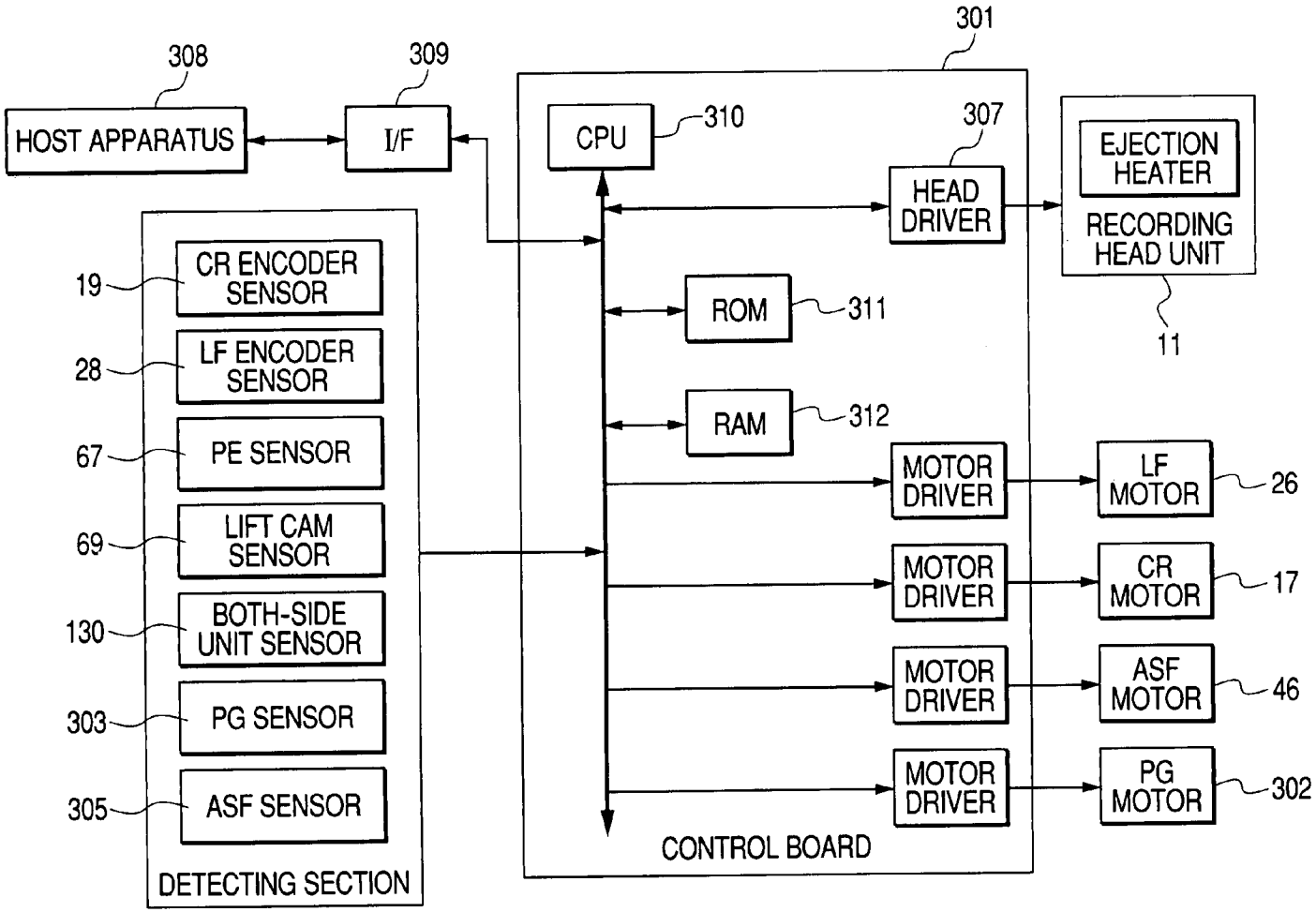
FIG. 3 is a block diagram representing a driving means for driving the entire recording apparatus to which the present invention is applied.

FIG. 3 is a block diagram representing a driving means for driving the entire recording apparatus to which the present invention is applied.

As shown in FIG. 3, the driving means has a CR encoder sensor 19 mounted on the carriage 13 for reading the code strip 18, an LF encoder sensor 28 mounted on the chassis 10 for reading the code wheel 27, an ASF motor 46 for driving the main ASF 37, a PE sensor 67 for detecting an operation of a PE sensor lever, a lift cam sensor 69 for detecting the operation of the lift camshaft 58, an inverting portion sensor 130 for detecting attachment and removal of the sheet inverting portion 2, a PG motor 302 for driving the maintenance unit 36, a PG sensor 303 for detecting the operation of the maintenance unit 36, an ASF sensor 305 for detecting the operation of the main ASF 37, a head driver 307 for driving the record head 11, a host apparatus 308 for sending record data to the recording apparatus, an I/F 309 for electrically interfacing between the host apparatus 308 and the recording apparatus, a CPU 310 for controlling the recording apparatus and issues a control command, an ROM 311 having control data and so on written thereto, and an RAM 312 as an area for loading the record data and so on.

First, an overview of the recording apparatus will be described by referring to FIGS. 1 and 2, and the operation of each portion will be described by using the drawings thereafter.

If the record data is sent from the host apparatus 308 and stored on the RAM 312 via the I/F 309, the CPU 310 issues a recording operation start command so as to start a recording operation. If the recording operation starts, the feed operation is performed first.

A feed portion is comprised of the main ASF 37, and draws out the recording paper sheet by sheet for each recording operation from a plurality of sheets thereof (not shown) loaded on the pressure-plate 41, and sends them to a conveying portion. If the ASF motor 46 rotates in a normal direction on starting the recording operation, its power rotates the cam holding the pressure-plate 41 by way of the gear row. IF the cam comes off due to the rotation, the pressure-plate 41 is energized in the direction of the paper feed roller 39 by an action of a pressure-plate spring not shown. At the same time, the paper feed roller 39 rotates in the direction for conveying the paper, and so the conveying of a topmost sheet of the loaded recording paper is started. At that time, a plurality of sheets may be conveyed at once due to a frictional force between the paper feed roller 39 and the recording paper and mutual conditions of the frictional force between the sheets of the recording paper. In that case, an effect is exerted by the separation roller 40 press-contacted by the paper feed roller 39 and having a predetermined return rotational torque in an opposite direction to the conveying direction so as to push back the recording paper other than the sheet closest to the paper feed roller 39 side onto the pressure-plate 41. On finishing an ASF feed operation, the separation roller 40 is released from a state of being press-contacted with the paper feed roller 39 by the operation of the cam to be separated by a predetermined distance. At that time, the return nail (not shown) rotates and plays a role of securely pushing back the recording paper to a predetermined position on the pressure-plate 41. the above operation conveys just one sheet of the recording paper to the conveying portion.

When a sheet of the recording paper is conveyed from the main ASF 37, the end thereof contacts the ASF flap 44 energized in the direction for blocking a passing route with an ASF flap spring. However, it passes there by pushing the ASF flap 44 away. If the recording operation of the sheet of the recording paper is finished and a back end of the sheet passes the ASF flap 44, the ASF flap 44 returns to its original energized condition and the passing route is closed. Therefore, even if the sheet is conveyed in a reverse direction, it will not return to the main ASF 37 side.

The recording paper conveyed from the feed portion is conveyed toward the nip portion between the paper feed roller 21 and pinch roller 22. As the pinch roller 22 is mounted with its center having a little offset against the center of the paper feed roller 21 in the direction for getting closer to the first ejection roller 30, a tangential angle for inserting the recording paper is a little inclined from level (or horizon). Thus, to have the end of the recording paper accurately guided to the nip portion, the recording paper is conveyed by being angled on the passing route formed by the pinch roller holder 23 and passing guide 70.

The paper conveyed by the main ASF 37 is struck against the nip portion of the paper feed roller 21 in a stopping state. At this time, a predetermined loop-like deformation is formed between the paper feed roller 39 and the paper feed roller 21 by having the paper conveyed by the main ASF 37 over a distance a little longer than a predetermined passing route length. The end of the recording paper is pressed on the nip portion of the paper feed roller 21 by a force of the recording paper itself to return the loop-like deformation to a straight state. Therefore, the end of the recording paper becomes parallel following the paper feed roller 21, and so-called registration for rendering the end of the recording paper parallel with the paper feed roller 21 is completed.

After completing the registration, the LF motor 26 is rotated in the direction for moving the recording paper in the normal direction (direction for proceeding toward the first ejection roller 30). Thereafter, the paper feed roller 39 has its driving force severed, and rotates together with the recording paper. At this point in time, the recording paper is conveyed only by the paper feed roller 21 and pinch roller 22. The recording paper advances in the normal direction by a predetermined line feed amount, and proceeds along a rib provided on the platen 29. The end of the recording paper gradually contacts the first ejection roller 30 and first spur row 32, and the second ejection roller 31 and second spur row 33. Peripheral speeds of the first ejection roller 30 and second ejection roller 31 are set almost equal to that of the paper feed roller 21, and the paper feed roller 21 is connected to the first ejection roller 30 and second ejection roller 31 by the gear rows. Therefore, they rotate in synchronization so that the recording paper is conveyed without loosening or being pulled.

A recording portion is mainly comprised of the record head 11 and carriage 13 having the record head 11 mounted thereon for scanning in the direction for intersecting with the conveying direction of the recording paper. The carriage 13 is supported by the guide shaft 14 and the guide rail 15 which is a part of the chassis 10. The driving force of the carriage motor 17 is transmitted via the carriage belt 16 set on the carriage motor 17 and idle pulley 20 so as to have the carriage 13 scan back and forth.

The record head 11 has a plurality of ink flow paths linked to the ink tank 12, and the ink flow paths are linked to a discharge nozzle row placed on a face opposed to the platen 29. An ink discharge actuator provided to each discharge nozzle is placed in the proximity of the discharge nozzle row. As for the discharge actuator, the one using a film boiling pressure of a liquid with an electro-thermal conversion element or an electro-pressure conversion element such as a piezo element is used.

It is possible to discharge ink drops according to the record data by transmitting a signal of the head driver 307 to the record head 11 via a flexible flat cable (not shown) It is also possible to discharge the ink drops to the recording paper in appropriate timing by reading the code strip 18 set on the chassis 10 with the CR encoder sensor 19 mounted on the carriage 13. If the recording of one line is thus finished, the recording paper is conveyed just by a necessary amount. It is possible to record on the entire face of the recording paper by repeatedly performing this operation.

A maintenance portion plays the roles of preventing the clogging of an ink discharge nozzle of the record head 11 and eliminating a stain due to paper powder and so on or absorbing the ink on replacement of the ink tank 12. For that reason, the maintenance unit 36 installed at a standby position of the carriage 13 to be opposed to the record head 11 is comprised of a cap (not shown) for protecting the nozzle by contacting a nozzle face of the record head 11, a wiper (not shown) for wiping the nozzle face, a pump (not shown) linked to the cap for generating a negative pressure in the cap and so on. When absorbing the ink in the nozzle of the record head 11, the ink is absorbed by pressing the cap onto the nozzle face of the record head 11 and driving the pump to generate the negative pressure in the cap. It also has a mechanism for having a wiper contact the nozzle face and move in parallel to eliminate the ink or a foreign matter when the ink or the foreign matter such as paper powder adhering to the nozzle face is found after absorbing the ink.

The above is the overview of the recording apparatus.

Next, a detailed description will be given as to a concrete configuration unique to this embodiment including the configuration of the sheet inverting portion 2.

The recording apparatus according to this embodiment is characterized by being capable of so-called automatic two-sided recording for automatically recording on both sides of sheet-like cutform paper without troubling a user of a printer.

First, the passing route of the recording paper will be described by using FIG. 2.

As shown in FIG. 2, the recording apparatus according to this embodiment has a switching flap 104 rotatably supported for deciding the passing direction of the recording medium, an exit flap 106 rotatably supported for opening and closing when the recording medium goes out of the sheet inverting portion 2, a first two-sided roller 108 and a second two-sided roller 109 for conveying the recording paper in the sheet inverting portion 2, a first two-sided pinch roller 112 driven by the first two-sided roller 108 and a second two-sided pinch roller 113 driven by the second two-sided roller 109.

If the recording operation starts, the recording paper is fed sheet by sheet by an action of the paper feed roller 39 from a plurality of the recording paper loaded on the main ASF 37 constituting a feeding conveying route so as to be conveyed to the paper feed roller 21. The recording paper held between the paper feed roller 21 and pinch roller 22 is conveyed in an arrow a direction in FIG. 2 which is a normal conveying direction thereof. In the case of performing the two-sided recording, the recording is performed on the right face (or front side surface) as the first face by the record head 11, and the recording paper is conveyed thereafter in an arrow b direction in FIG. 2 which is a reverse conveying direction in the horizontal path provided below the main ASF 37. The main ASF 37 has the sheet inverting portion 2 placed behind it, which constitutes a conveying route for inversion merging into the feeding conveying route of the main ASF 37 upstream in the conveying direction in the more normal direction than the paper feed roller 39. Therefore, the recording paper is led from the horizontal path to the inside of the sheet inverting portion 2 so as to be conveyed thereafter in an arrow c direction in FIG. 2. In the sheet inverting portion 2, it shifts its traveling direction while being held between the second two-sided roller 109 and second two-sided pinch roller 113 and is further conveyed in an arrow d direction in FIG. 2 while being held between the first two-sided roller 108 and first two-sided pinch roller 112 so as to return to the horizontal path eventually by changing its traveling direction by 180 degrees. The recording paper conveyed in the horizontal path in the arrow a direction in FIG. 2 is held between the paper feed roller 21 and pinch roller 22 again, and is recorded by the record head 11 on the backside (or rear side surface) as the second face. As described above, the recording paper after finishing the recording on the right face is inverted by the horizontal path below the main ASF 37 and the sheet inverting portion 2 behind the main ASF 37, and is recorded on its backside again so as to have the recording automatically performed on both sides thereof.

Here, a description will be given as to a recording range of the recording paper on right face recording. The record head 11 has an ink discharge nozzle area N between the paper feed roller 21 and first ejection roller 30. However, it is usually difficult to place the ink discharge nozzle area N very close to the nip portion of the paper feed roller 21 in terms of placement of the ink flow paths on the nozzle and wiring to an actuator for discharging the ink. Therefore, it is only possible, in the range where the recording paper is held at the nip portion between the paper feed roller 21 and pinch roller 22, to perform the recording to the extent of being distant from the nip portion of the paper feed roller by a length L1 shown on a downstream side in FIG. 2. To reduce this bottom margin area on the right face, the recording apparatus according to this embodiment continues the recording operation up to a portion in which the recording paper comes off the nip portion of the paper feed roller 21 and is held only by the first ejection roller 30 and second ejection roller 31 to be conveyed. Thus, the recording operation until the bottom margin area on the right face becomes zero is possible.

To carry the recording paper in the arrow b direction in FIG. 2 from this state as previously mentioned, however, it may not be possible to guide the recording paper to the nip portion between the paper feed roller 21 and pinch roller 22 so that a so-called jam may occur. In order to avoid the jam, it is possible, according to this embodiment, to create a predetermined clearance by releasing the pinch roller 22 from the paper feed roller 21 and draw the end of the recording paper into the clearance and then press-contact the pinch roller 22 to the paper feed roller 21 again so as to allow the recording paper to be conveyed in the arrow b direction in FIG. 2.

Next, a description will be given as to a release mechanism of the pinch roller 22, the release mechanism of the PE sensor lever, a pressure adjustment mechanism of the pinch roller spring, an up-and-down mechanism of the passing guide and the up-and-down mechanism of the carriage, which are characteristics of this embodiment.

As previously mentioned, the pinch roller 22 is released for the sake of drawing the recording paper in again. It has some other mechanisms for the sake of inverting the recording paper after drawing it in again.

One of them is the release mechanism of the PE sensor lever. A normal PE sensor lever is mounted to swing at a predetermined angle to the conveyed recording paper in order to accurately detect the positions of the end and back end of the recording paper when the recording paper proceeds in the normal direction. Therefore, in the case where the recording paper proceeds in the reverse direction, there is a problem that the end of the recording paper gets stuck with the PE sensor lever or the end of the PE sensor lever bites into the recording paper being conveyed. For that reason, this embodiment is constituted so that the PE sensor lever is released from a passing face up to halfway through an inverting process of the recording paper so as not to contact the recording paper. The release mechanism of the PE sensor lever is not essential to the purpose of the present invention, and it may be replaced by other means. To be more specific, it is also possible, as the means for solving the problem, to provide a roller at the end of the PE sensor lever so that the roller rotates even if the recording paper proceeds in the reverse direction. It is also possible to take a large angle by which the PE sensor lever swings so that the PE sensor lever swings at the angle in the reverse-to-normal direction when the recording paper is conveyed in the reverse direction.

Another mechanism is the pressure adjustment mechanism of the pinch roller spring 24. According to this embodiment, the entire pinch roller holder 23 is rotated in order to release the pinch roller 22. In the state of press-contacting the pinch roller 22 to the paper feed roller 21, the pinch roller holder 23 is pressed by the pinch roller spring 24. Therefore, if the pinch roller holder 23 is rotated in a release direction, the pinch roller spring 24 changes its direction to increase its energizing force, which has adverse effects such as increase in a load for releasing the pinch roller holder 23 and increase in the force applied to the pinch roller holder 23 itself. To prevent these adverse effects, the pressure adjustment mechanism for reducing the energizing force of the pinch roller spring 24 on releasing the pinch roller holder 23 is provided.

A further mechanism is the up-and-down mechanism of the passing guide. To guide the recording paper conveyed from the main ASF 37 to the paper feed roller 21, the passing guide 70 is normally positioned at a place at a little higher angle than the horizontal path (the state shown in FIG. 2) so as to lead the recording paper smoothly to the nip portion of the paper feed roller 21 slightly angled from horizon as previously mentioned. If as-is, however, the recording paper is guided toward the main ASF 37 again in the case where the recording paper is conveyed in the arrow b direction in FIG. 2. Therefore, to prevent it and allow the recording paper to be smoothly guided to the horizontal path, it is more suitable to change the angle and render the passing guide 70 horizontal. The up-and-down mechanism of the passing guide is provided for this reason.

A last mechanism is the up-and-down mechanism of the carriage 13. When the pinch roller holder 23 is in a released state, the end of it gets closer to the carriage 13. Therefore, this mechanism is intended to prevent them from contacting and rendering the carriage 13 unable to move in the main scan direction. For this reason, the carriage 13 rises in synchronization with a release operation of the pinch roller holder 23. The up-and-down mechanism of the carriage 13 may also be applied to other uses. For instance, it can be used to move the carriage 13 to avoid contact between the record head 11 and the recording paper when recording on thick recording paper.

Hereafter, the five mechanisms will be described in detail.

Figure 4:
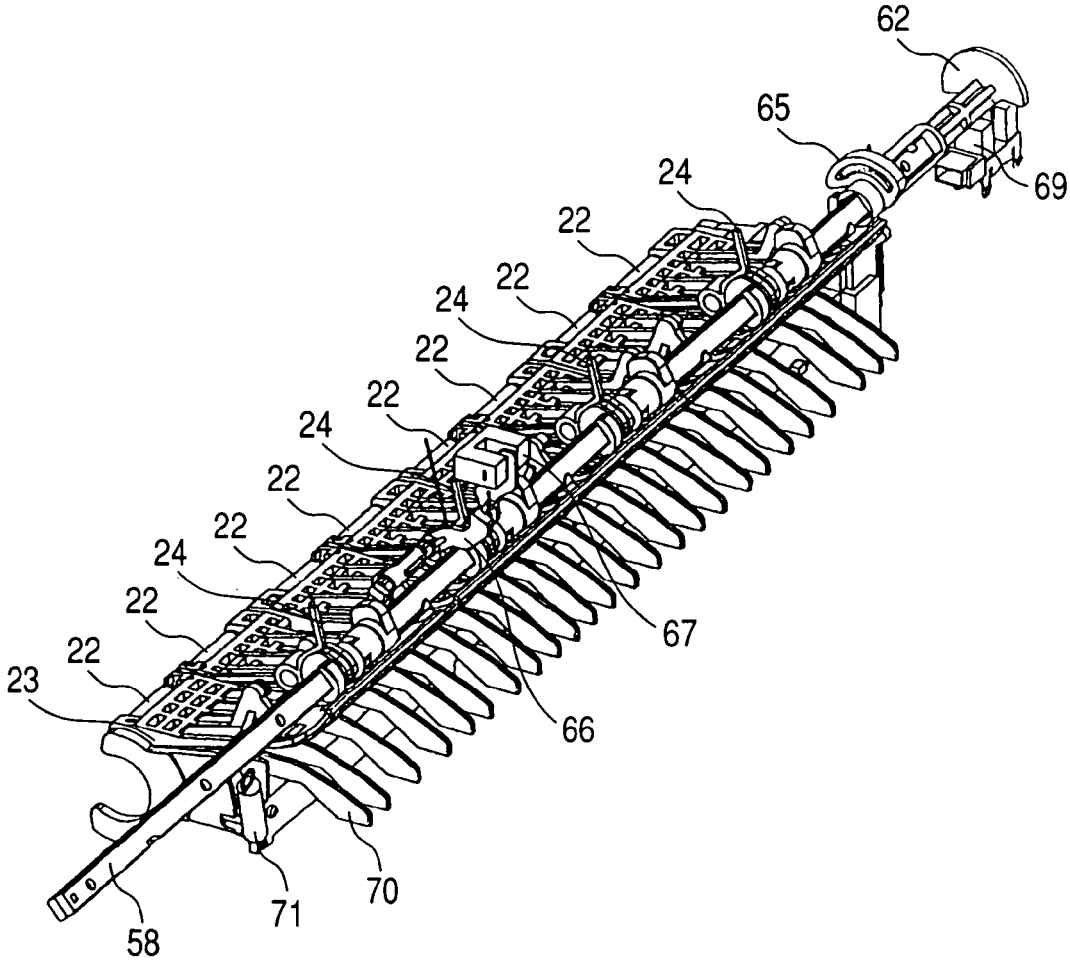
FIG. 4 is a schematic perspective view showing an overview of a pinch roller release mechanism, a PE sensor lever release mechanism, a pinch roller spring pressure adjustment mechanism and a passing guide up-and-down mechanism.

FIG. 4 is a schematic perspective view showing an overview of the pinch roller release mechanism, PE sensor lever release mechanism, pinch roller spring pressure adjustment mechanism and passing guide up-and-down mechanism.

The mechanisms shown in FIG. 4 have a pinch roller holder pressure cam 59 contacting the pinch roller 22 (refer to FIGS. 5A to 5C), a pinch roller spring pressure cam 60 to be a point of action of the pinch roller spring 24 (refer to FIGS. 5A to 5C), a PE sensor lever pressure cam 61 contacting a PE sensor lever 66 (refer to FIGS. 6A and 6B), a lift camshaft shielding plate 62 for indicating the angle of the lift camshaft 58, a passing guide pressure cam 65 contacting the passing guide 70, the PE sensor lever 66 for contacting the recording paper and detecting the end and back end thereof, the PE sensor 67 transmitted and shielded by the PE sensor lever 66, a PE sensor lever spring 68 for energizing the PE sensor lever 66 in a predetermined direction (refer to FIGS. 6A and 6B), a lift cam sensor 69 transmitted and shielded by the lift camshaft shielding plate 62, and a passing guide spring 71 for energizing the passing guide 70 in a predetermined direction.

The pinch roller release mechanism, PE sensor lever release mechanism, pinch roller spring pressure adjustment mechanism and passing guide up-and-down mechanism are operated by the rotation of the lift camshaft 58. According to the mechanism of this embodiment, the lift camshaft 58 has the pinch roller holder pressure cam 59, pinch roller spring pressure cam 60, PE sensor lever pressure cam 61 and passing guide pressure cam 65 fixed thereto respectively. Therefore, each individual cam operates in synchronization with one turn of the lift camshaft 58. Here, an initial angle and one turn of the lift camshaft 58 are recognized by having the lift cam sensor 69 transmitted or shielded by the lift camshaft shielding plate 62. The purpose of the present invention is not thereby restricted, but the mechanism for driving each of them independently may also be adopted.

Next, the operation of each mechanism will be described.

Figure 5A:
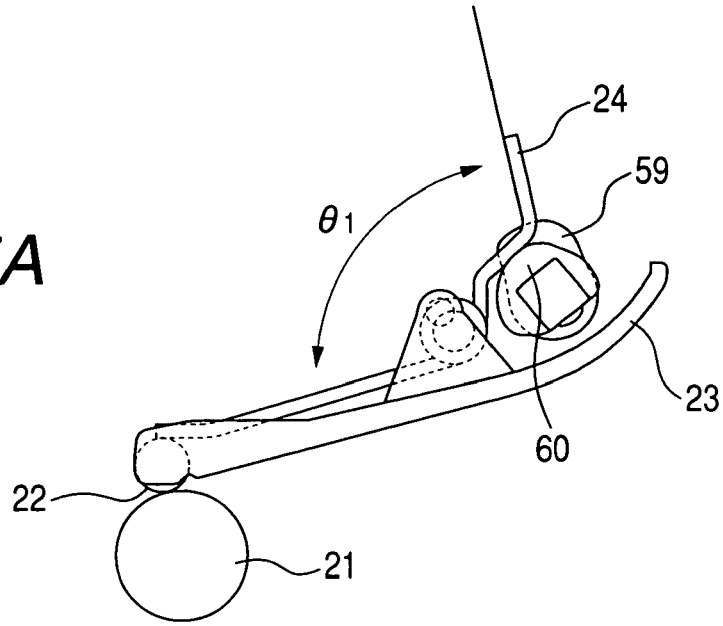
FIGS. 5A, 5B and 5C are schematic side views showing operations of the pinch roller release mechanism and pinch roller spring pressure adjustment mechanism.
Figure 5B:
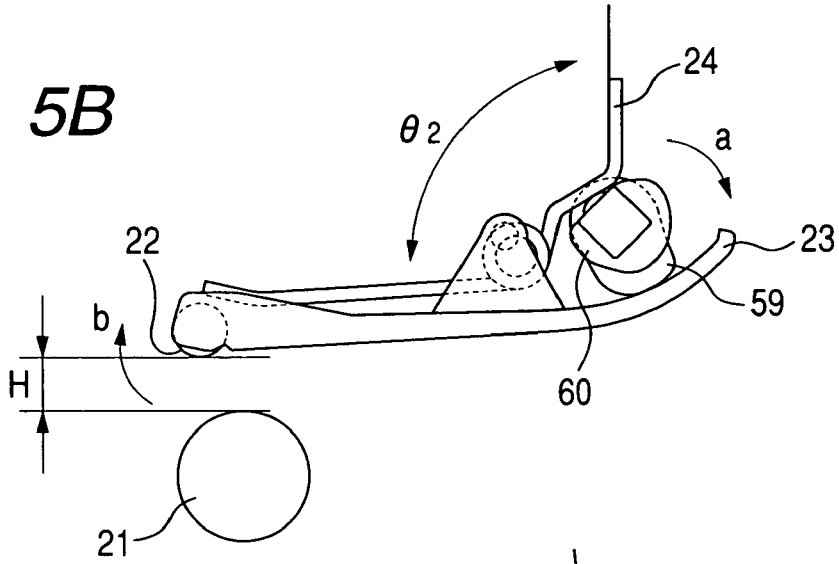
Figure 5C:
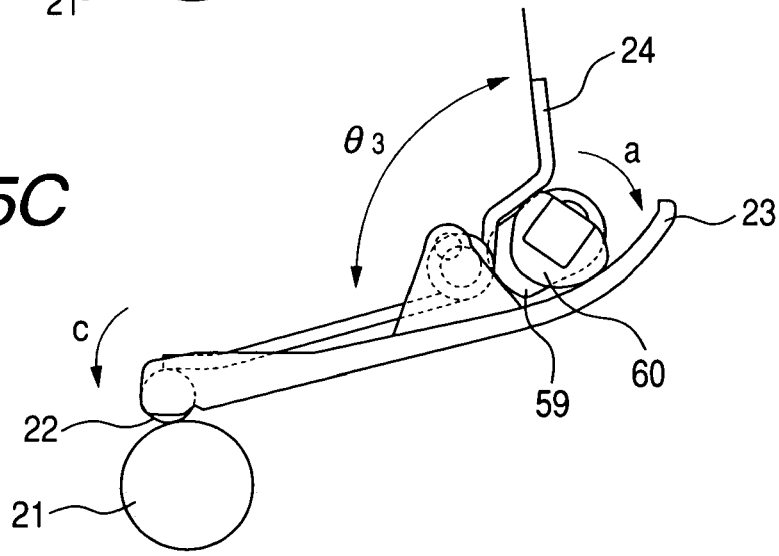

FIGS. 5A to 5C are schematic side views showing the operations of the pinch roller release mechanism and pinch roller spring pressure adjustment mechanism.

FIG. 5A is a diagram showing the case where the pinch roller holder pressure cam 59 is at an initial position, and the energizing force of the pinch roller spring 24 is in a standard state while press-contacted to the pinch roller 22. The pinch roller holder 23 has a pinch roller holder shaft 23*a* rotatably supported by a bearing portion of the chassis 10, and is swingable in a predetermined angle range. The pinch roller holder 23 has the pinch roller 22 rotatably supported at one end thereof, and has an area contacting the pinch roller holder pressure cam 59 provided at the other end. The pinch roller spring 24 is a torsion coil spring having one end thereof contacting the pinch roller 22 side of the pinch roller holder 23 as a power point, the other end supported by the pinch roller spring pressure cam 60, and its spring center supported by a supporting portion of the chassis 10. In such a supporting form, the pinch roller 22 is press-contacted to the paper feed roller 21 at a predetermined pressure. In this state, it is possible, by operating a rotary drive mechanism of the paper feed roller 21 not shown, to carry the recording paper held the nip portion between the paper feed roller 21 and pinch roller 22.

FIG. 5B is a diagram showing the case where the pinch roller 22 is in the released state, and the pinch roller spring 24 is in a state of no load. To be more specific, because of the rotation of the lift camshaft 58 in the arrow a direction in FIG. 5B, the pinch roller holder pressure cam 59 contacts the pinch roller holder 23 and is gradually rotated in the arrow b direction in FIG. 5B, and the pinch roller 22 is released from the paper feed roller 21. The pinch roller spring pressure cam 60 has a small-radius portion contacting the pinch roller spring 24, and a twist angle θ2 of the pinch roller spring 24 is wider than that in FIG. 5A so that a spring load is reduced and almost no load is on the pinch roller holder 23. Thus, the pinch roller holder 23 has almost no stress exerted thereto. In this state, a clearance H of a predetermined amount is made between the paper feed roller 21 and the pinch roller 22 so that even roughly guided recording paper can easily insert its end into the nip portion.

FIG. 5C is a diagram showing the case where the pinch roller 22 is press-contacted to the paper feed roller 21 as in FIG. 5A but is in a weak press-contacting state with a weak press-contacting force. To be more specific, the lift camshaft 58 further rotates in the arrow a direction in FIG. 5C in this case so that the contact between the pinch roller holder pressure cam 59 and the pinch roller holder 23 is released, the pinch roller holder 23 rotates in the arrow c direction in FIG. 5C to return to its original state and the pinch roller spring pressure cam 60 has the face of the radius between FIGS. 5A and 5C contacting the pinch roller spring 24. Thus, a twist angle θ3 of the pinch roller spring 24 is slightly smaller than that in FIG. 5A, and so the force for press-contacting the pinch roller 22 to the paper feed roller 21 is slightly reduced. Thus, in the case where the recording paper thicker than usual is held between the paper feed roller 21 and the pinch roller 22, it is possible to prevent the twist angle of the pinch roller spring 24 from becoming larger than usual and generating a larger load. Therefore, it is possible, whether the recording paper is of usual thickness or thicker than usual, to level a rotation load due to rotation resistance of the paper feed roller 21.

If the lift camshaft 58 is rotated once after going through the above states, the mechanisms return to the state shown in FIG. 5A to be in a standard state.

Figure 6A:
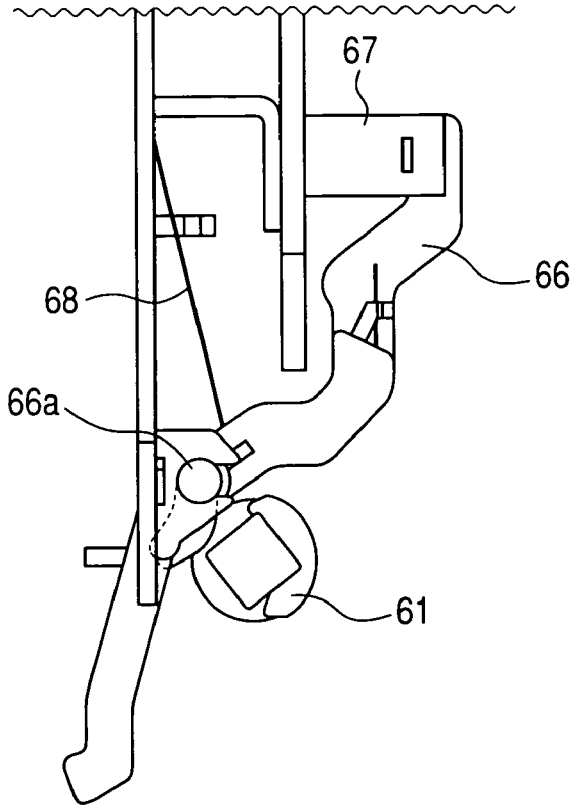
FIGS. 6A and 6B are schematic side views showing the operations of a PE sensor lever up-and-down mechanism.
Figure 6B:
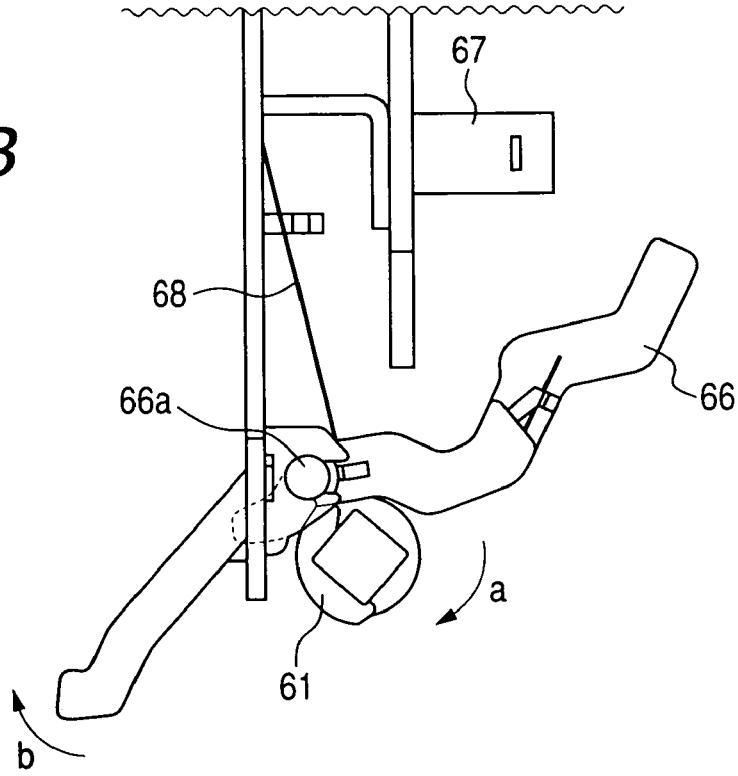

FIGS. 6A and 6B are schematic side views showing the operations of the PE sensor lever up-and-down mechanism.

FIG. 6A is a diagram showing the case where the PE sensor lever pressure cam 61 is at the initial position and the PE sensor lever 66 is in a free state. The PE sensor lever 66 has a PE sensor lever shaft 66*a* rotatably supported by a bearing portion of the chassis 10. In this state, the PE sensor lever 66 is energized at the position shown in the diagram by action of the PE sensor lever spring 68, and the PE sensor 67 is shielded by the shielding plate of the PE sensor lever 66. If the recording paper passes through the PE sensor lever 66 from this state, the PE sensor lever 66 rotates clockwise in FIG. 6A and the PE sensor 67 becomes transmissive so as to detect existence of the recording paper. The end or back end of the recording paper is detected in this shielded and transmissive state.

FIG. 6B is a diagram showing the state in which the PE sensor lever 66 is locked. To be more specific, the PE sensor lever pressure cam 61 rotates in the arrow a direction in FIG. 6B so that a cam follower portion of the PE sensor lever 66 is pushed up to rotate in the arrow b direction in FIG. 6B. In this state, a sheet detecting portion of the PE sensor lever 66 is hidden inside the pinch roller holder 23, and so the recording paper does not contact the PE sensor lever 66 even if the recording paper is on a passing path. Thus, even if the recording paper is conveyed in this state in the arrow b direction in FIG. 2, the recording paper will not cause the jam by hitting the PE sensor lever 66.

Figure 7A:
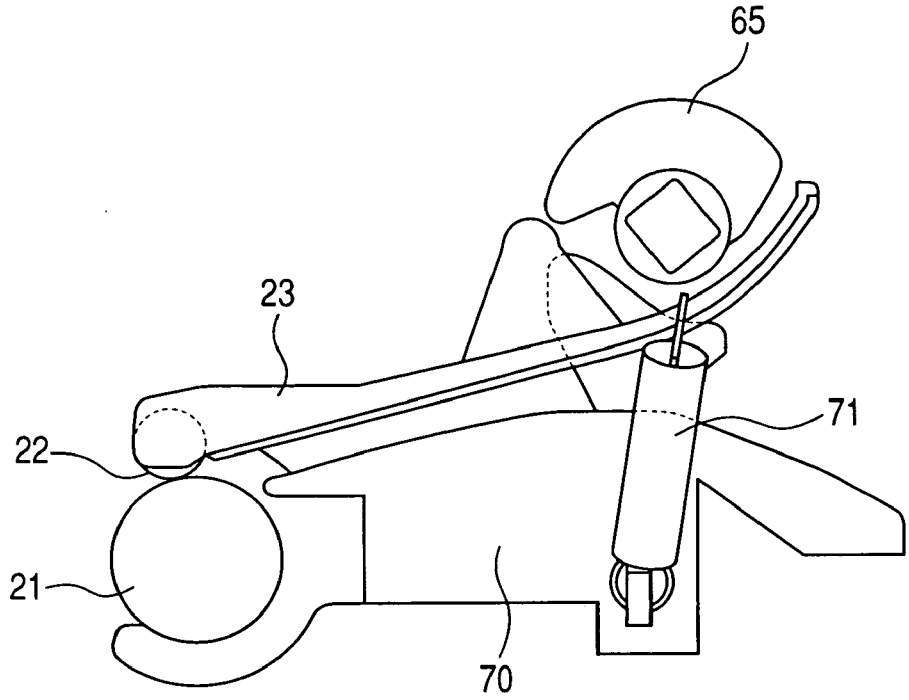
FIGS. 7A and 7B are schematic side views showing the operations of the passing guide up-and-down mechanism.
Figure 7B:
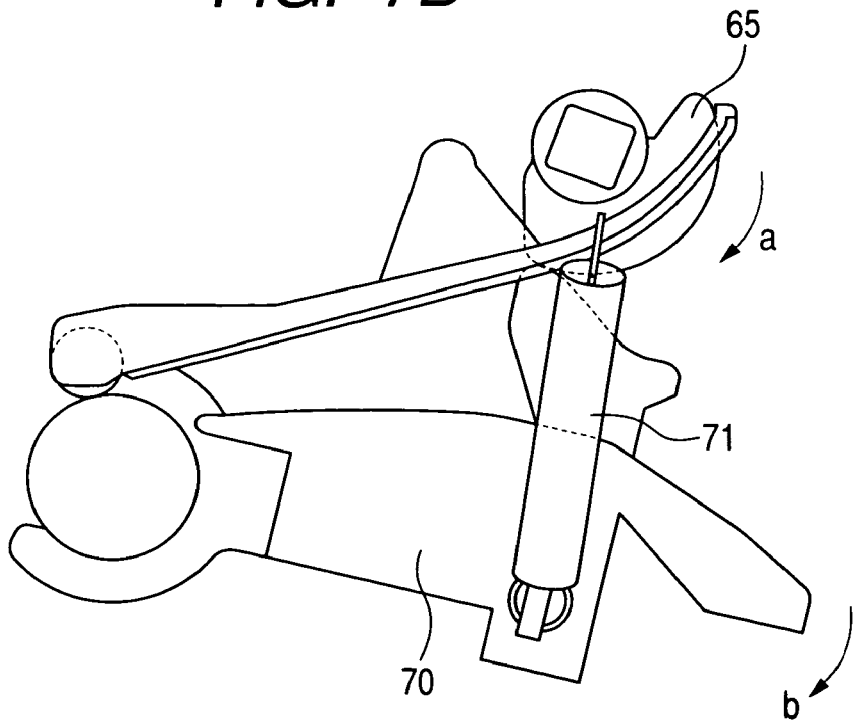

FIGS. 7A and 7B are schematic side views showing the operations of the passing guide up-and-down mechanism.

FIG. 7A is a diagram showing the state in which the passing guide 70 is at an upper position. The passing guide 70 is normally energized in the direction for being lifted by the passing guide spring 71, and its position is decided by hitting a stopper not shown. It keeps this position by the action of the passing guide spring 71 in the case where the recording paper is fed from the main ASF 37 and passes. In the case where a force greater than usual is exerted, however, the passing guide 70 can lower against the force of the passing guide spring 71.

FIG. 7B is a diagram showing the state in which the passing guide 70 is at a lower position. The passing guide pressure cam 65 fixed to the lift camshaft 58 rotates in the arrow a direction in FIG. 7B so that the passing guide pressure cam 65 gradually contacts a passing guide cam follower portion 70*a* which is a part of the passing guide 70, and the passing guide 70 rotates in the arrow b direction in FIG. 7B to be pushed down against the force of the passing guide spring 71. In this state, a portion of the passing guide 70 facing the passing path becomes approximately horizontal, and the passing path becomes almost completely straight. Thus, even in the case where the recording paper is conveyed further in the arrow b direction than the paper feed roller 21 in FIG. 2, the recording paper is horizontally conveyed, and an already recorded portion on the right face of the recording paper is no longer pushed on the passing path.

Figure 8:
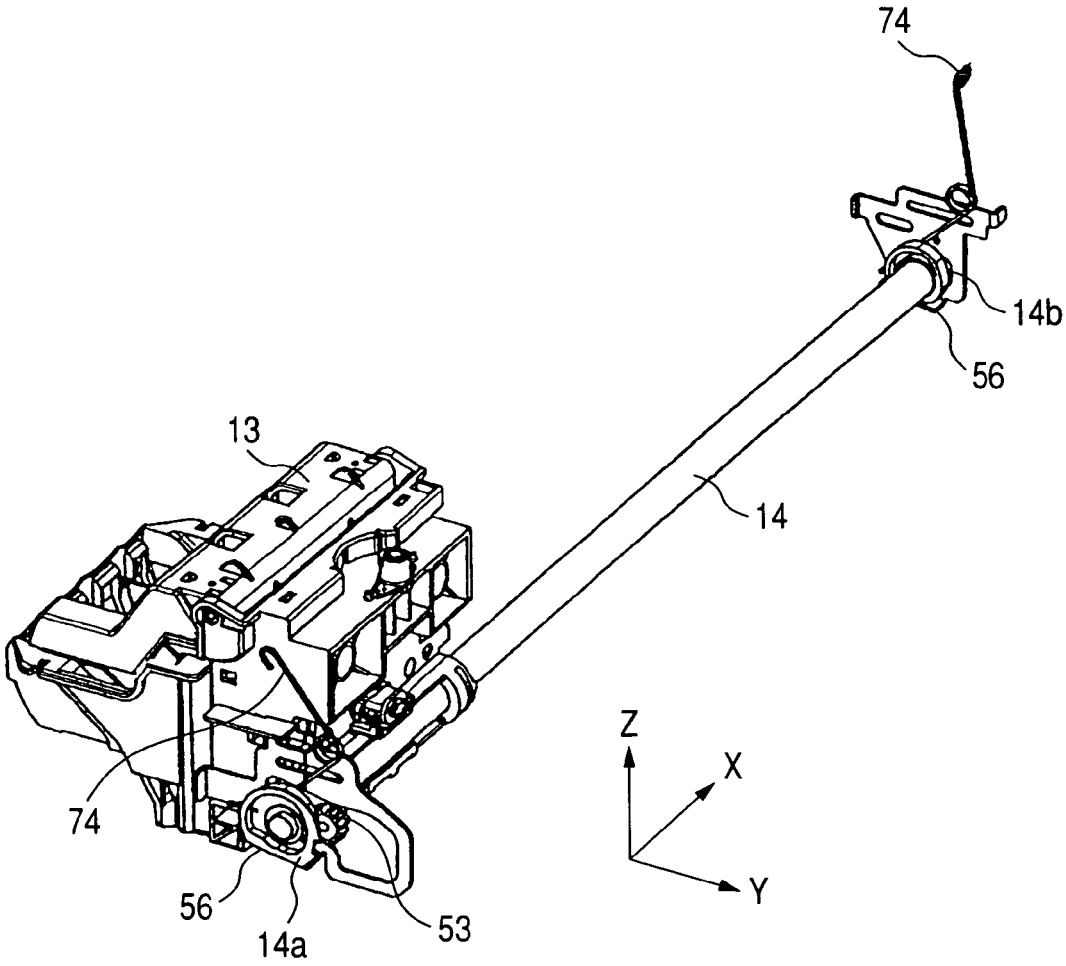
FIG. 8 is a schematic perspective view showing a carriage up-and-down mechanism.

FIG. 8 is a schematic perspective view showing the carriage up-and-down mechanism.

In FIG. 8, reference numeral 14*a* denotes a guide shaft cam R mounted on the guide shaft 14, 14*b* denotes a guide shaft cam L mounted likewise on the guide shaft 14, and 53 denotes a cam idler gear for linking the lift cam gear 52 (refer to FIG. 1) to a gear integral to the guide shaft cam R14*a*.

The guide shaft 14 is supported by both side plates of the chassis 10 as shown in FIG. 1, where a vertical guide elongate hole not shown and the guide shaft 14 fit, and it is freely movable in an arrow Z direction in FIG. 8 although move in an arrow X direction and an arrow Y direction in FIG. 8 is restricted. The guide shaft 14 is normally energized downward (opposite direction to the arrow Z) by a guide shaft spring 74 according to this mechanism. However, the guide shaft cam R14*a* and guide shaft cam L14*b* contact the guide incline 56 as the cam idler gear 53 rotates, and the guide shaft 14 itself goes up and down while rotating.

Figure 9A:
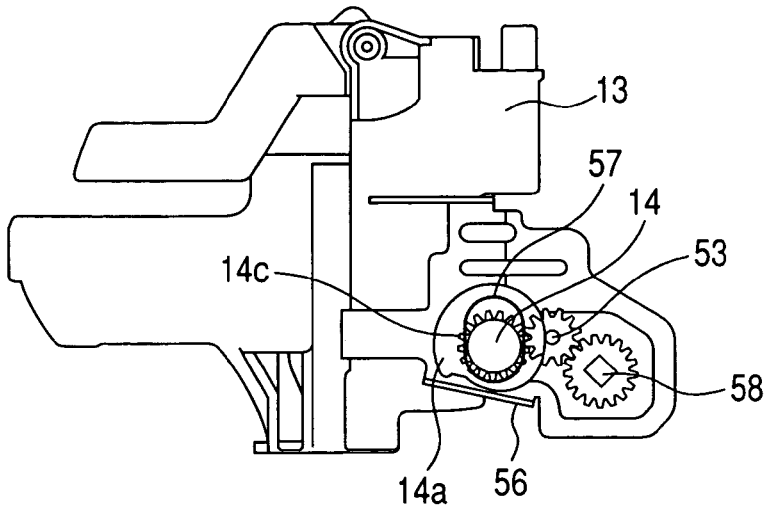
FIGS. 9A, 9B and 9C are schematic side views showing the operation of the carriage up-and-down mechanism.
Figure 9B:
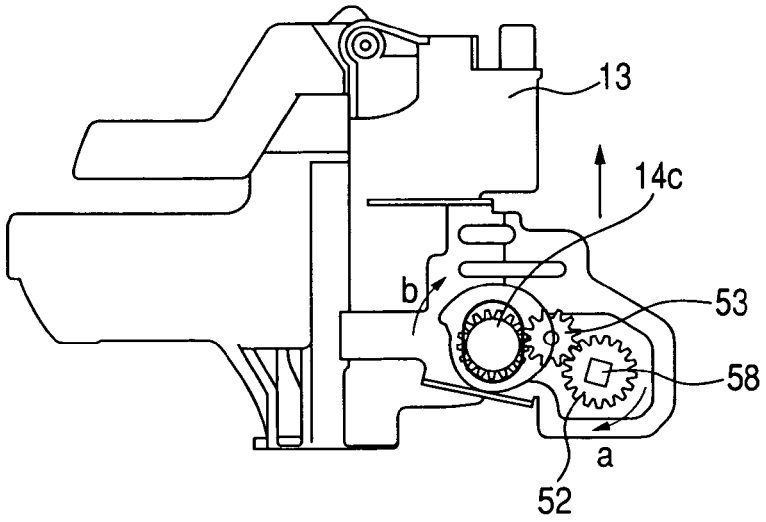
Figure 9C:
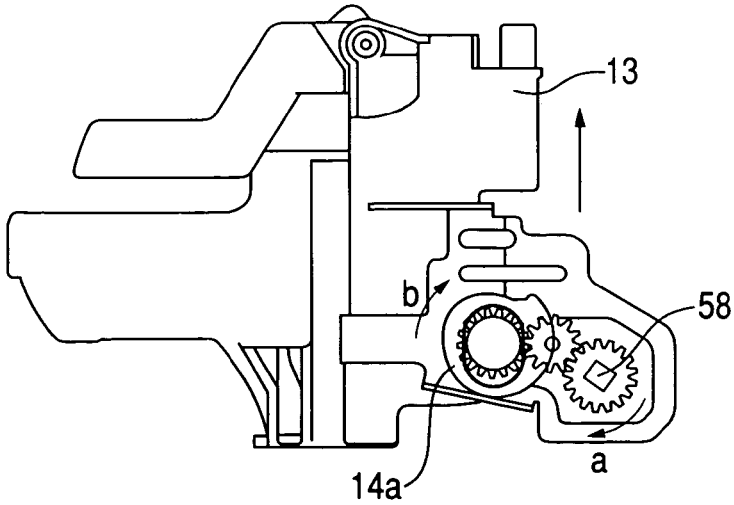

FIGS. 9A to 9C are schematic side views showing the operation of the carriage up-and-down mechanism.

FIG. 9A is a diagram showing the case where the carriage 13 is at a first position which is a standard position. In this state, the guide shaft 14 has its position decided by hitting a lower limit of a guide elongate hole 57 of the chassis 10, where the guide shaft cam R14*a* does not contact the guide incline 56.

FIG. 9B is a diagram showing the case where the carriage 13 has moved to a second position which is a little higher than the standard position. From the first position, the lift cam gear 52 fixed on the lift camshaft 58 rotates due to the rotation of the lift camshaft 58, and a guide shaft cam R gear 14*c* rotates via the cam idler gear 53 engaging with the lift cam gear 52.

In this case, if the lift cam gear 52 and the guide shaft cam R gear 14*c* have the same number of cogs, the lift camshaft 58 and guide shaft 14 rotate at approximately the same angle and in approximately the same direction. They do not rotate at completely the same angle because, while the lift cam gear 52 and cam idler gear 53 have their rotary shafts fixed, the guide shaft cam R gear 14*c* has the guide shaft 14 as the rotary shaft moving up and down so that the distance between the gears changes.

As described above, if the lift camshaft 58 rotates in the arrow a direction in FIG. 9B, the guide shaft 14 also rotates in the arrow b direction in FIG. 9B. Because of this rotation, the guide shaft cam R14*a* and guide shaft cam L14*b* contact the fixed guide incline 56 respectively, and move to the second position since a moving direction of the guide shaft 14 is restricted to be only vertical by the guide elongate hole 57 of the chassis 10 as previously mentioned. The second position is suited to be set up in the case where the recording paper is deformed such that the recording paper contacts the record head 11 (refer to FIG. 1) at the first position.

FIG. 9C is a diagram showing the case where the carriage 13 is at a third position which is the highest. As the lift camshaft 58 rotates further than the second position, the radiuses of cam faces of the guide shaft cam R14*a* and guide shaft cam L14*b* become larger so as to move to a still higher position. The third position is suitable in the case of using the recording medium thicker than usual.

The five mechanisms were described in detail as above.

Next, the drive mechanism of the lift camshaft 58 will be described.

According to this embodiment, a driving source of the lift camshaft 58 is the ASF motor 46 for driving the main ASF 37. Either the main ASF 37 or the lift camshaft 58 is operated by controlling a rotation direction and a rotation amount of the ASF motor 46.

Figure 10:
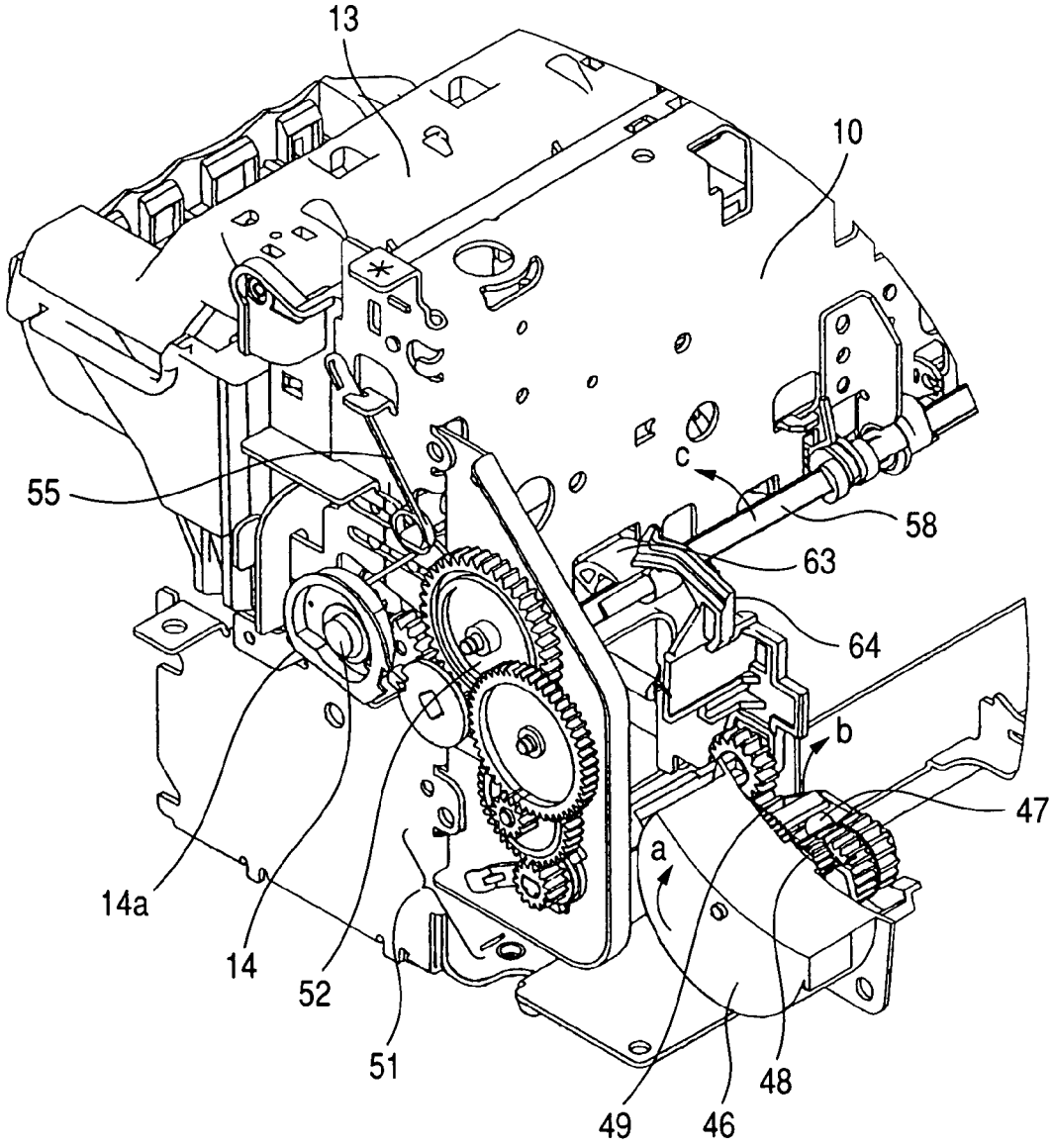
FIG. 10 is a schematic perspective view showing a lift camshaft drive mechanism.

FIG. 10 is a schematic perspective view showing a lift camshaft drive mechanism.

In FIG. 10, reference numeral 46 denotes an ASF motor (shown with its upper half cut off to display gears) as the driving source, 47 denotes an ASF pendulum arm positioned at a next stage to the gears mounted on the ASF motor 46, 48 denotes an ASF sun gear mounted at a center of the ASF pendulum arm 47, 49 denotes an ASF planet gear mounted at the end of the ASF pendulum arm 47 and engaging with the ASF sun gear 48, and 64 denotes a pendulum lock lever which swings by acting on a pendulum lock cam 63 fixed on the lift camshaft 58.

As previously mentioned, a driving force transmission direction is decided by the rotation direction of the ASF motor 46. In the case of a purpose of operating the lift camshaft 58, however, the ASF motor 46 is rotated in the arrow a direction in FIG. 10. Then, the gears mounted on the ASF motor 46 rotate the ASF sun gear 48. As the ASF sun gear 48 and the ASF pendulum arm 47 are rotatably engaged with a predetermined frictional force, the ASF pendulum arm 47 swings in the rotation direction of the ASF sun gear 48, that is, in the arrow b direction in FIG. 10. Then, the ASF planet gear 49 engages with the lift input gear 50 of the next stage. Thus, the driving force of the ASF motor 46 is transmitted to the lift cam gear 52 via the lift deceleration gear row 51. At this time, the ASF pendulum arm 47 is swinging in the arrow b direction in FIG. 10 so that the driving force to the gear row for driving the main ASF 37 is severed.

Inversely, in the case of driving the main ASF 37 side, the ASF motor 47 is rotated in the opposite direction to the arrow a in FIG. 10 so that, as opposed to the above, the ASF pendulum arm 47 swings in the opposite direction to the arrow b in FIG. 10. Thus, the engagement of the ASF planet gear 49 and the lift input gear 50 is released, and another ASF planet gear 49 provided to the ASF pendulum arm 47 engages with the gear row on the main ASF 37 side so as to drive the main ASF 37.

The ASF motor 46 uses a so-called stepping motor and is controlled by an open loop according to this embodiment. It goes without saying that it may be closed-loop control by using an encoder on a DC motor and so on.

Here, in the case where a planet gear mechanism is used for driving force transmission, there is a possibility that, when a driven side has a minus load, it may cause so-called look-ahead wherein the pendulum lock lever 64 moves to disengage the gears and a phase on the driven side advances further than the driving source. To prevent this, the pendulum lock cam 63 and pendulum lock lever 64 are provided according to this embodiment. In the case where the lift camshaft 58 is in the predetermined angle range, the pendulum lock lever 64 swings in the arrow c direction in FIG. 10 due to a cam face shape of the pendulum lock cam 63 so that the pendulum lock lever 64 engages with the ASF pendulum arm 47 to fix it not to return to the side for driving the main ASF 37. Thus, the ASF planet gear 49 is constantly engaged with the lift input gear 50, and so the ASF motor 46 and lift camshaft 58 constantly rotate in synchronization.

If the pendulum lock cam 63 returns to the predetermined angle range, the pendulum lock lever 64 returns to the opposite direction to the arrow c in FIG. 10, and the ASF pendulum arm 47 is unlocked so as to return to the state capable of transmitting the drive to the main ASF 37 side by reversing the ASF motor 46.

The above described mechanisms allow the release of the pinch roller 22, locking of the PE sensor lever 66, pressure adjustment of the pinch roller spring 24, up-and-down movement of the passing guide 70 and up-and-down movement of the carriage 13. Hereafter, the five kinds of movable mechanisms are collectively called lift mechanisms.

Next, a description will be given as to how the mechanisms operate in correlation.

FIGS. 11A to 11D are schematic side views showing the operations of the carriage 13, pinch roller 22, PE sensor lever 66 and passing guide 70.

Figure 11A:
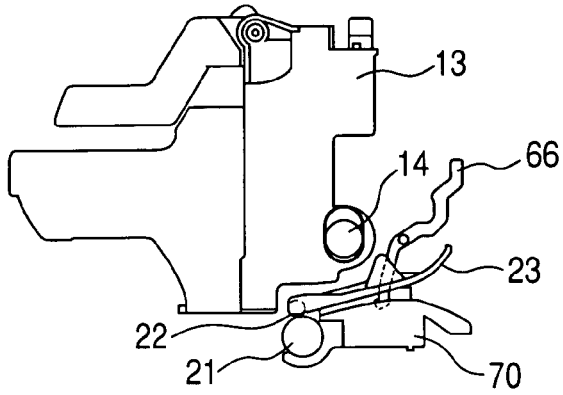
FIGS. 11A, 11B, 11C and 11D are schematic side views showing the operations of the carriage, pinch roller, PE sensor lever and passing guide.

FIG. 11A is a diagram showing the case where the lift mechanisms are at the first position. In this state, the pinch roller 22 is press-contacted to the paper feed roller 21, the PE sensor lever 66 is in a free state, the pinch roller spring 24 is press-contacted at a normal pressure, the passing guide 70 is at the upper position, and the carriage 13 is at the first position. This state is the position used for the recording operation using normal recording paper or the registration after inverting the recording paper in the sheet inverting portion 2.

Figure 11B:
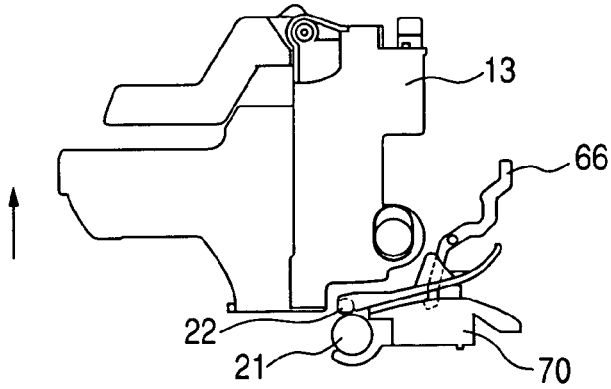

FIG. 11B is a diagram showing the case where the lift mechanisms are at the second position. In this state, the pinch roller 22 is press-contacted to the paper feed roller 21, the PE sensor lever 66 is in the free state, the pinch roller spring 24 is press-contacted at the normal pressure, the passing guide 70 is at the upper position, and the carriage 13 is at the second position. If compared to the first position of the lift mechanisms, only the carriage 13 is different at the second position. The second position is the position used to solve a situation in the case where the recording paper is deformed such that the recording paper rasps the record head 11 (refer to FIG. 1) or in the case of using the recording paper which is rather thick.

Figure 11C:
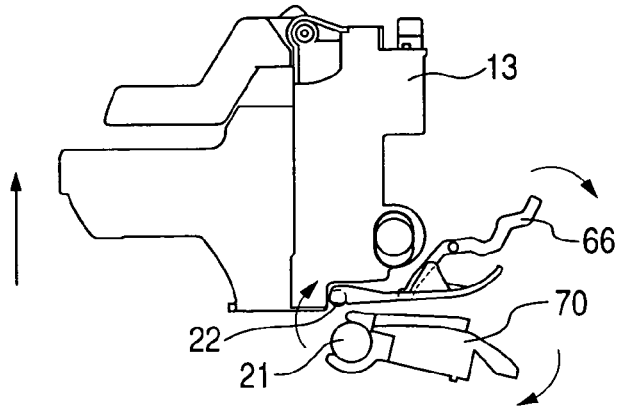

FIG. 11C is a diagram showing the case where the lift mechanisms are at the third position. In this state, the pinch roller 22 is released from the paper feed roller 21 and has the predetermined clearance, the PE sensor lever 66 is retracted upward and locked, the pinch roller spring 24 has its press-contacting force weakened, the passing guide 70 is at the lower position, and the carriage 13 is at the third position which is the highest. If compared to the second position of the lift mechanisms, all the states have changed, the passing path is straightly released, and the recording paper can be drawn in at the third position. The third position is the position used in the case of conveying the recording paper in the arrow b direction in FIG. 2 after finishing the right face recording or in the case of inserting the thick recording paper.

Figure 11D:
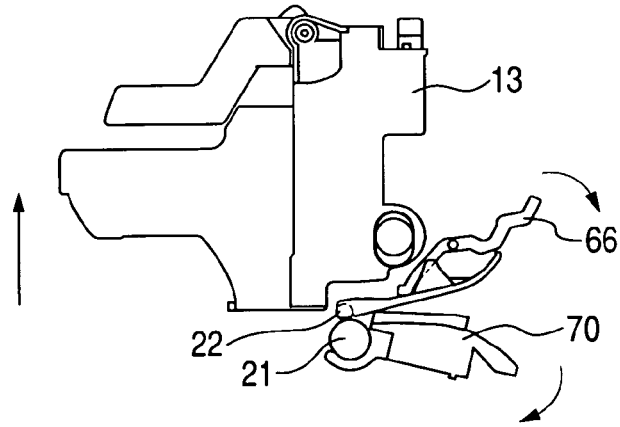

FIG. 11D is a diagram showing the case where the lift mechanisms are at a fourth position. In this state, the pinch roller 22 is press-contacted to the paper feed roller 21, the PE sensor lever 66 is retracted upward and locked, the pinch roller spring 24 is press-contacted at a rather weak pressure, the passing guide 70 is at the lower position, and the carriage 13 is at the third position which is the highest. If compared to the third position of the lift mechanisms, the fourth position is changed such that the pinch roller 22 has returned to the press-contacting state, and the pinch roller spring 24 is press-contacted at a rather weak pressure. The fourth position is the position used in the case of conveying the recording paper toward the sheet inverting portion 2 after drawing the recording paper in again on the automatic two-sided recording or in the case of recording by using the thick recording paper.

According to this embodiment, the mechanisms are simplified by limiting the positions of the lift mechanisms to the four kinds in consideration of the operation of the recording apparatus. To be more specific, the positions of the lift mechanisms change in circle such as the first position, second position, third position, fourth position and then first position while the lift camshaft 58 rotates once. The purpose of the present invention is not thereby restricted, but each mechanism element may operate independently. The pressure adjustment mechanism of the pinch roller spring 24 is not essential, and may be omitted in the case where the pinch roller holder 23 is sufficiently rigid or in the case where load change of the LF motor 26 is not a problem. The up-and-down mechanism of the passing guide 70 is not necessary in the case of the mechanism capable of neatly guiding the end of the recording paper to the nip portion of the paper feed roller 21 by means of placement of the main ASF 37 even if the passing guide 70 is horaizontal.

Figure 12:
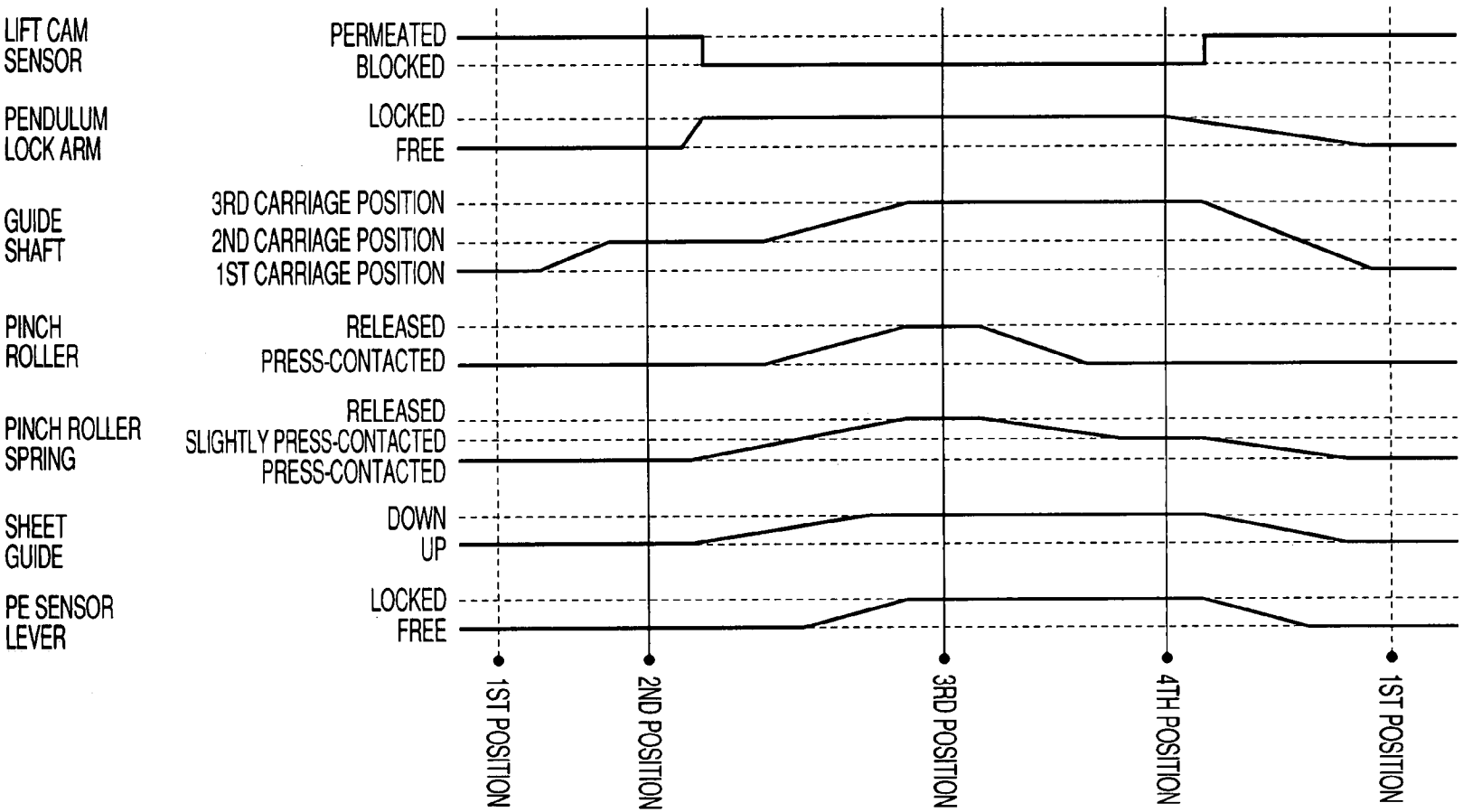
FIG. 12 is a timing chart showing an operating state of lift mechanisms.

To render the contents described above with the schematic side views easier to understand, a description will be given again by using a timing chart. FIG. 12 is a timing chart showing an operating state of the lift mechanisms. A horizontal axis in FIG. 12 shows the angle of the lift camshaft 58 in the range of 360 degrees, and a vertical axis shows each mechanism element and its position. As shown in FIG. 12, it is possible, by operating the lift camshaft 58 and guide shaft 14 in synchronization, to simultaneously operate a plurality of mechanisms just by detecting the angle of the lift camshaft 58 with the lift cam sensor 69 and controlling the rotation angle of the ASF motor 46.

The operation of the lift mechanisms was described above.

Next, a concrete description will be given as to how to automatically record on both sides of the recording paper.

Figure 13A:
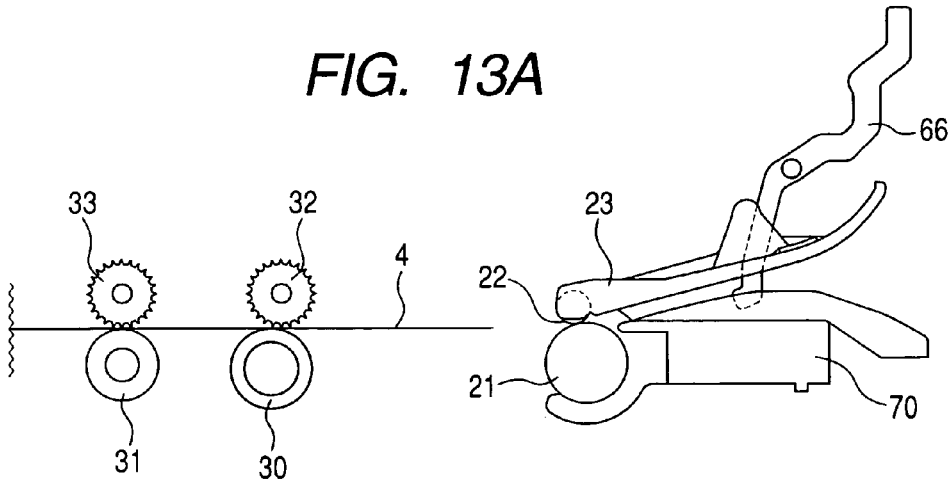
FIGS. 13A, 13B and 13C are schematic side views describing a process of drawing recording paper into a nip portion of a paper feed roller again after finishing right face recording of the recording paper.
Figure 13B:
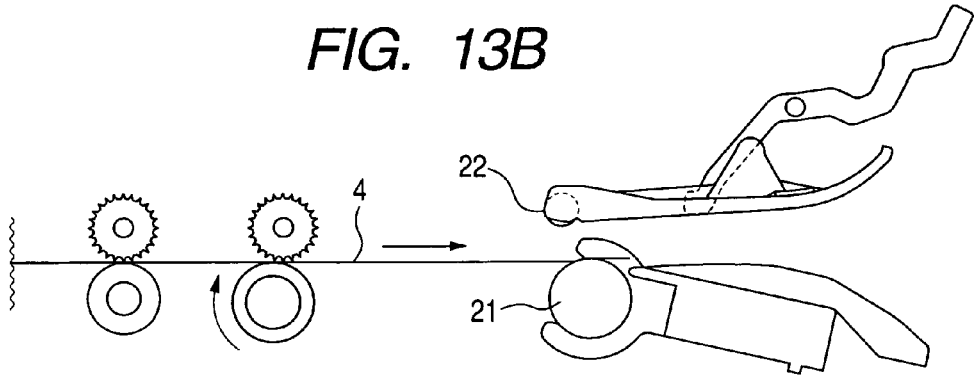
Figure 13C:
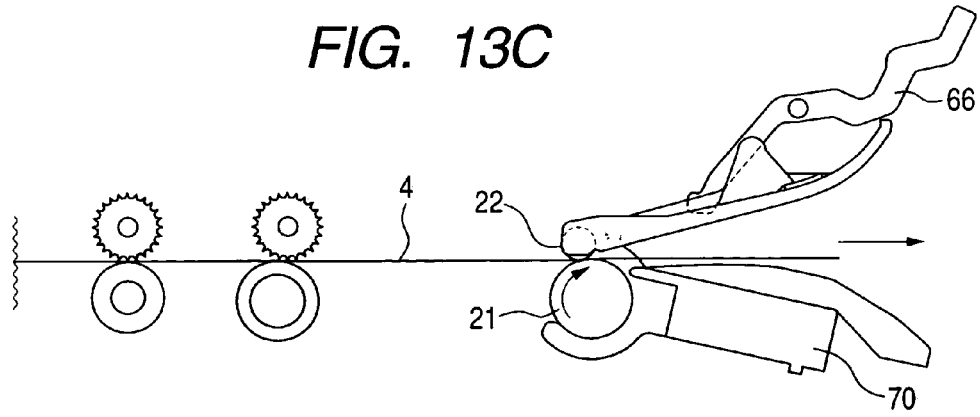

FIGS. 13A to 13C are schematic side views describing a process of drawing the recording paper into the nip portion of the paper feed roller 21 again after finishing the right face recording of the recording paper.

FIG. 13A is a diagram showing the state in which the right face recording of recording paper 4 is finished and the recording paper is held by the first ejection roller 30, first spur row 32 and the second ejection roller 31, second spur row 33. In this case, the lift mechanisms are in the state of the first position or the second position. As previously mentioned, if the recording is performed by advancing the recording paper 4 to this state, the discharge nozzle row of the record head 11 can be opposed up to the very back end of the recording paper 4. Therefore, it is possible to record on the recording paper 4 without making the bottom margin.

Next, the lift mechanisms are moved to the third position, and a large clearance of a predetermined size is made between the pinch roller 22 and the paper feed roller 21 so that the recording paper 4 can be easily drawn in even if its back end is undulating or cambering. At this time, the carriage 13 may be at any position in the main scan direction because the pinch roller holder 23 does not interfere with the carriage 13.

FIG. 13B is a diagram showing the state in which the recording paper is conveyed in the arrow b direction in FIG. 2 (hereafter, conveying the recording paper 4 in this direction will be referred to as a back-feed) and is stopped after moving to a location below the pinch roller 22. It is stopped in this state because the recording apparatus according to this embodiment adopts a wet inkjet recording method. To be more specific, a recorded face of the recording paper 4 (upside face in FIG. 13) is wet in ink immediately after the recording operation. Therefore, if immediately press-contacted by the pinch roller 22 and the paper feed roller 21, the ink may be transferred to the pinch roller 22 and then retransferred to the recording paper 4 so as to stain the recording paper 4.

It depends on numerous conditions whether or not the ink gets transferred to the pinch roller 22, that is, whether or not the ink discharged on the recording paper 4 is dry in other words. To be more specific, it depends on the conditions such as the kind of recording paper, the kind of ink to be used, an overstriking method of the ink, an overstriking amount of the ink per unit area, a temperature and a humidity of an environment in which the recording operation is performed and a gas flow rate. Roughly speaking, the ink is apt to dry fast in the case of using the recording paper having an ink accepting layer on the right face and capable of promptly leading the ink to the inside. The ink is also apt to dry fast in the case of using the ink such as a dye of which particles are small enough to infiltrate inside the recording paper. The ink is also apt to dry fast in the case of an ink system using a chemically reactive ink and solidifying it by overstriking it on the right face of the recording paper. The ink is also apt to dry fast in the case of reducing the amount of ink overstruck per unit area. The ink is also apt to dry fast in the case of increasing the temperature of the environment in which the recording operation is performed. The ink is also apt to dry fast in the case of decreasing the humidity of the environment in which the recording operation is performed. The ink is also apt to dry fast in the case of accelerating the gas flow rate of the environment in which the recording operation is performed.

As described above, necessary drying time is decided under several conditions. Therefore, this embodiment uses the configuration wherein a predetermined ink system is used to specify the drying time necessary when performing the recording under general use conditions (general recording paper, general recording environment) as a standard value so as to change the drying time according to a predictable condition. The predictable condition in this case is the amount of ink overstruck per unit area. It is also possible, however, to further predict a drying standby time in detail by using ambient temperature detection means, ambient humidity detection means, ambient wind speed detection means and so on in conjunction with it.

For instance, it is possible to set up the method whereby data received from the host apparatus 308 is stored on the RAM 312, and the amount of ink overstruck per unit area is calculated to compare a maximum value thereof to a predetermined threshold described on the ROM 311 so as to decide the drying standby time. To be more specific, it is possible to extend the drying standby time in the case where the maximum value of the amount of ink overstruck per unit area is large and shorten the drying standby time in the case where it is small so as to optimize the drying standby time according to a recording pattern. The drying standby time is also different depending on whether the kind of ink used for the recording is a dye ink or a pigment ink. The drying standby time is shortened in the case of the dye ink because it easily dries, and is extended in the case of the pigment ink because it does not dry easily. And the drying standby time is shortened in the case of a high ambient temperature because it easily dries, and is extended in the case of a low ambient temperature because it does not dry easily. And the drying standby time is extended in the case of the high ambient humidity because it does not dry easily, and is shortened in the case of a low ambient humidity because it easily dries. And the drying standby time is shortened in the case of the recording paper having an ink accepting layer on the right face and capable of promptly leading the ink to the inside thereof because it easily dries, and is extended in the case of the recording paper of a strong water-shedding quality because it does not dry easily.

It is also possible to stand by for drying at the position in FIG. 13A. It is more suitable, however, to back-feed the recording paper 4 up to the position in FIG. 13B and stand by mainly because of the deformation of the recording paper 4. To be more specific, in the case where the recording is performed on the recording paper by a wet ink-jet process, the recording paper absorbs moisture so that fibers of the paper may expand and the recording paper may get extended. There may be extending portions and non-extending portions on the recording paper depending on a pattern to be recorded. In such cases, concavities and convexities are most conspicuously formed on the paper. The amount of concavities and convexities mainly depends on the time having elapsed from a start of moisture absorption on the recording paper. As the time elapses, the amount of concavities and convexities increases and converges to a predetermined amount of deformation. If the amount of deformation of the end of the paper increases over time, there is a possibility that the end of the paper interferes with the pinch roller 22 and causes the jam even if the pinch roller 22 is released away from the paper feed roller 21. To prevent this, the recording paper is back-fed after the recording and before the deformation of the concavities and convexities becomes significant so as to move the recording paper to the location below the pinch roller 22. For the above reason, the back end of the right face of the recording paper 4 is back-fed to the position in FIG. 13B to wait until the recorded portion of the recording paper dries.

FIG. 13C is a diagram showing the state in which the recording paper is conveyed to the sheet inverting portion 2. If the recorded portion of the recording paper 4 dries and the ink is no longer transferred to the pinch roller 22 even if the pinch roller 22 is press-contacted, the lift mechanisms are moved to the fourth position to hold the recording paper 4 between the pinch roller 22 and the paper feed roller 21. The paper feed roller 21 is driven in this state to back-feed the recording paper 4. At this time, the PE sensor lever 66 is rotated upward and locked so that its end will not bite into the recording paper 4 or rasp and peel the recorded portion. As the passing guide 70 is at the lower position, its passing face is approximately horaizontal so that the recording paper 4 can be conveyed straight to the sheet inverting portion 2.

This embodiment is based on the state in which the passing guide 70 is at the upper position. However, the purpose of the present invention is not thereby restricted, and it may also be based on the state in which the passing guide 70 is at the lower position. To be more specific, it is possible to put it in a normal standby state at the third position or fourth position of the lift mechanisms and move it to the first position on the feed operation from the main ASF 37. It is possible, by having such a configuration, to smoothly insert the recording medium of high rigidity when inserting it from the ejection roller side.

The process from the end of the front face recording on the recording paper 4 to conveying it to the sheet inverting portion 2 was described above.

Next, a description will be given as to a form of conveying the recording paper inside the sheet inverting portion 2.

Figure 14:
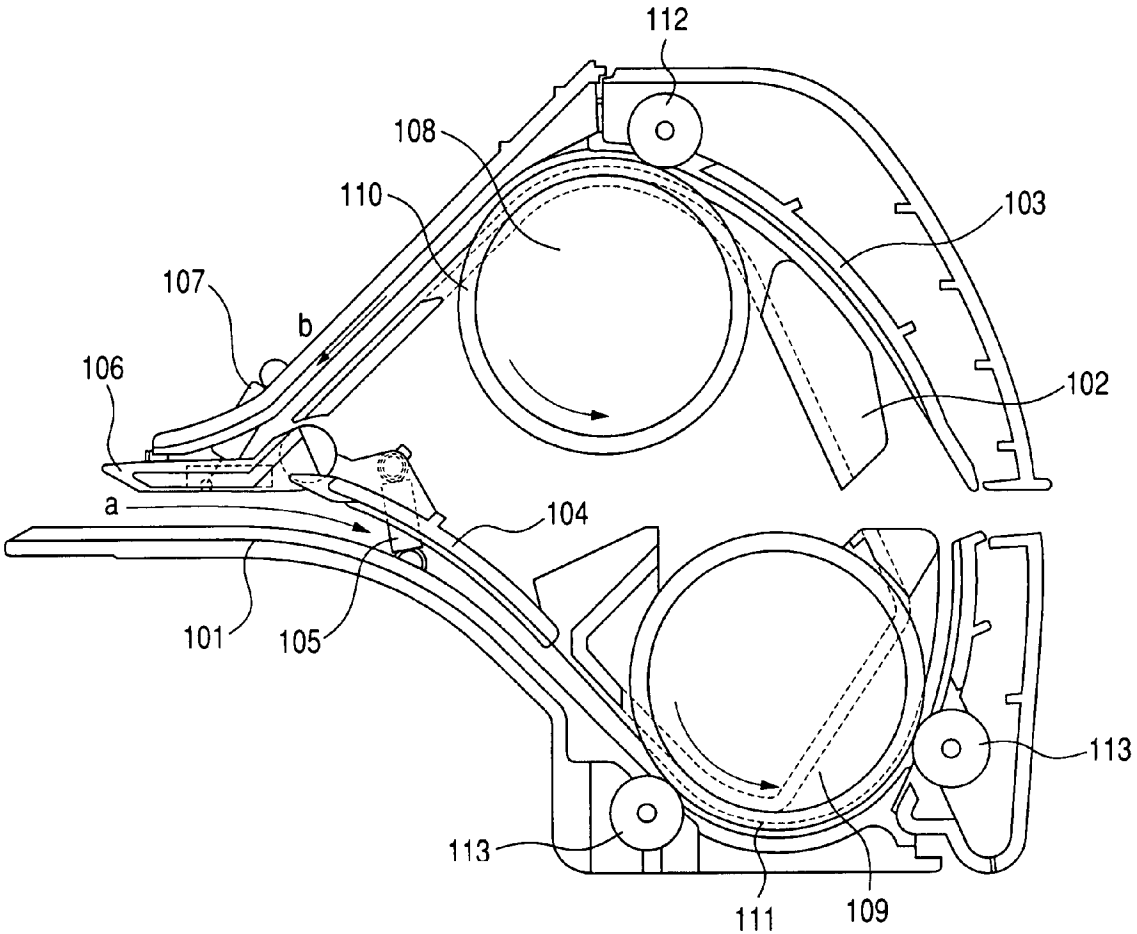
FIG. 14 is a schematic side sectional view showing paper feed paths of a sheet inverting portion and a state of installing a conveying roller.

In FIG. 14, reference numeral 101 denotes a sheet inverting portion frame constituting a structure of the sheet inverting portion and a part of the conveying route, 102 denotes an internal guide fixed inside the sheet inverting portion frame 101 and constituting a part of the conveying route, 103 denotes a rear cover placed to be capable of opening and closing in the rear of the sheet inverting portion frame 101 and constituting a part of the conveying route, 105 denotes a switching flap spring for energizing the switching flap 104 in a predetermined direction, 107 denotes an exit flap spring for energizing the exit flap 106 in a predetermined direction, 110 denotes a first two-sided roller rubber which is a rubber portion of the first two-sided roller 108, and 111 denotes a second two-sided roller rubber which is the rubber portion of the second two-sided roller 109.

When the recording paper 4 is conveyed to the sheet inverting portion 2 from the state in FIG. 13C, the exit flap 106 is energized at the position in FIG. 14 by the action of the exit flap spring 107 so that an introducing route is uniquely decided. For this reason, the recording paper 4 proceeds in the arrow a direction in FIG. 14. Next, the recording paper 4 hits the switching flap 104. In the case of the recording paper capable of normal two-sided recording, however, the load of the switching flap spring 105 is set up not to rotate the switching flap 104. Therefore, the recording paper 4 proceeds along the passing route between the switching flap 104 and the sheet inverting portion frame 101.

The recording paper 4 is held as-is between them in the direction in which the recorded face thereof (right face) contacts the second two-sided roller rubber 111 of the second two-sided roller 109 and an unrecorded face (backside) contacts the second two-sided pinch roller 113 made of a highly lubricant polymeric resin. In this case, the first two-sided roller 108, second two-sided roller 109 and paper feed roller 21 are set to rotate at approximately the same peripheral velocity by the drive mechanism described later. Therefore, the recording paper 4 is conveyed without causing slippage between it and the second two-sided roller 109. As the peripheral velocity is approximately the same, the recording paper 4 neither loosens nor has a tensile force exerted thereon.

If the traveling direction is changed by the second two-sided roller 109, the recording paper 4 proceeds along the rear cover 103 and is held likewise between the first two-sided roller rubber 110 of the first two-sided roller 108 and the first two-sided pinch roller 112. The traveling direction is changed again by the first two-sided roller 108, and the recording paper 4 is conveyed in the arrow b direction in FIG. 14. If the recording paper 4 proceeds as-is, the end thereof contacts the exit flap 106. As the exit flap 106 is energized by the exit flap spring 107 of a very weak load so that the recording paper 4 itself pushes away the exit flap 106 and goes out of the sheet inverting portion 2. A passing path length in the sheet inverting portion 2 is set so that, when the end of the recording paper 4 in the traveling direction goes out of the exit flap 106, the back end thereof is already passing below the exit flap 106. Therefore, the end and back end of the recording paper 4 itself do not mutually contact.

Although a detailed flowchart thereof will be described later, it is possible to measure a recording paper length with the PE sensor lever 66 when recording on the right face of the recording paper 4. Therefore, when inserting the recording paper shorter than the distance from the paper feed roller 21 to the second two-sided roller 109 or the distance from the first two-sided roller 108 to the paper feed roller 21 or the recording paper longer than the distance starting from the exit flap 106 of the sheet inverting portion 2, going round and returning to the exit flap 106, an alert is issued at the stage of finishing the right face recording and the recording paper 4 is ejected without conveying it to the sheet inverting portion 2.

Figure 15:
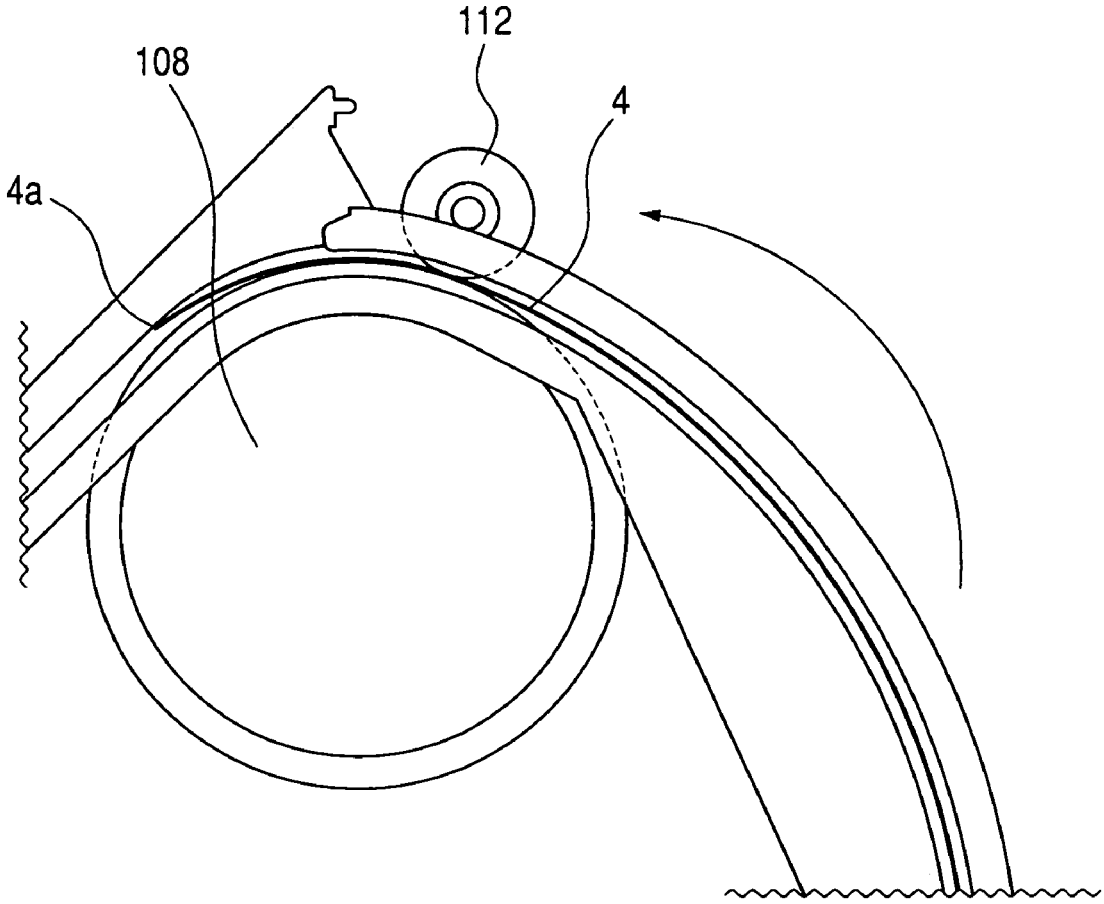
FIG. 15 is a schematic side sectional view showing a standby state on taking a measure against floating of a backside end of the recording paper.

Next, a description will be given as to a standby operation as a measure against floating of a backside end performed while conveying the recording paper inside the sheet inverting portion 2. FIG. 15 is a schematic side sectional view showing a standby state on taking the measure against floating of the backside end of the recording paper.

In FIG. 15, reference numeral 4*a* denotes a backside end portion (right face back end portion) of the recording paper 4. As previously mentioned, the recording apparatus according to this embodiment adopts a wet inkjet recording method. For that reason, if a large amount of ink is overstruck on the recorded face (right face) (the amount of ink overstruck per unit area is large), the recording paper 4 absorbs a large amount of moisture so that the fibers of the paper may expand and the recording paper gets deformed on the opposite side to the recorded face for a while after the recording. If the recording paper 4 is conveyed in that state inside the sheet inverting portion 2 to the platen 29 and backside recording is performed, the backside end portion 4*a* of the recording paper 4 curls in the direction of the carriage 13 and may contact the carriage 13 or contact the spur base 34 to cause the jam. As the measure against it according to this embodiment, as shown in FIG. 15, it stands by for a predetermined time, for the sake of curling the backside end portion 4*a* of the recording paper 4 downward (direction for moving away from the record head 11 mounted on the carriage 13) while conveying the recording paper 4, in the state of having the backside end portion 4*a* of the recording paper 4 held at the nip portion between the first two-sided roller 108 and first two-sided pinch roller 112 in the conveying route for inversion of the sheet inverting portion 2.

As for the position for standing by, a desirable position is a curve where it is possible to curl the recording paper 4 downward in the conveying route. As a matter of course, the standby position for curling changes in the case of an inverting mechanism for inverting the recording paper 4 by conveying it in the opposite direction to the arrow in FIG. 15, that is, in the case of conveying the recorded face (right face) to the outside. In the case where a small amount of ink is overstruck on the right face, the recording paper 4 absorbs a small amount of moisture so that the paper expands just a little. Thus, the amount of ink per unit area is calculated and compared to the threshold so as to decide the standby time. To be more specific, it is possible to extend the standby time in the case where the maximum value of the amount of ink per unit area is large and shorten the standby time in the case where it is small so as to optimize the standby time according to the recording pattern. In the case where the right face recording is close to the end (back end of the backside), there is not much influence of curling the backside end portion 4*a* upward. Therefore, the control portion of the recording apparatus stores the area in which the right face recording is performed, and the standby operation is performed only in the case where that recording area is in the range of a predetermined distance (4 inches (approximately 10.2 cm) for instance) from the right face back end portion. In the case where the recording paper 4 is heavy paper of which rigidity is high such as a postcard, however, the curl due to the absorption of the ink hardly occurs so that it is not necessary to perform this standby.

An inverting operation for recording on both sides of the normal recording paper was described above.

Next, a description will be given as to the operation of the sheet inverting portion 2 in the case of recording on the recording medium of high rigidity without performing the automatic two-sided recording.

As for the recording medium of high rigidity, the cases of conveying the recording medium of the heavy paper 2 to 3 mm thick, in disciform shape or irregular shape on a predetermined tray are assumed. As such recording media are highly rigid, they are not capable of the automatic two-sided recording since they cannot curve enough to follow a diameter of the two-sided roller in the sheet inverting portion 2. However, there may be a situation in which the recording on such recording media is desired with the sheet inverting portion 2 mounted on the recording apparatus. In the case where the recording medium is highly rigid, it is not possible to feed the paper by using the main ASF 37. In that case, the recording medium is fed from the ejection roller side to the paper feed roller 21 side in order to use a straight passing path. The operation of the sheet inverting portion 2 in that case will be described below.

Figure 16A:
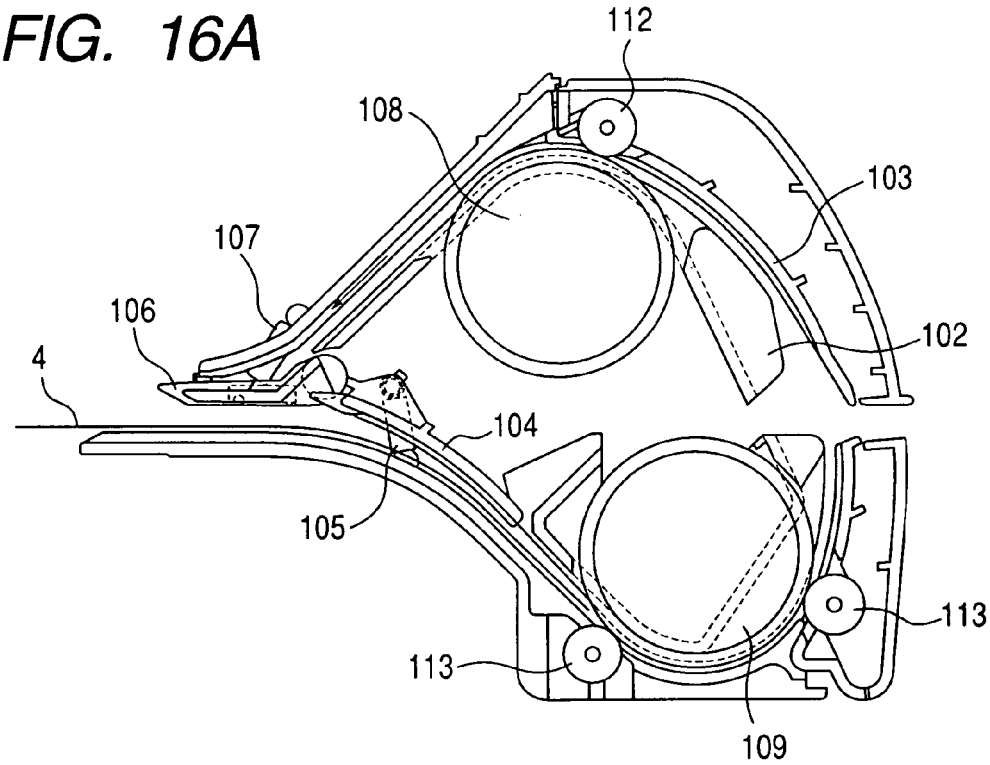
FIGS. 16A and 16B are schematic side sectional views describing the operation of a switching flap.
Figure 16B:
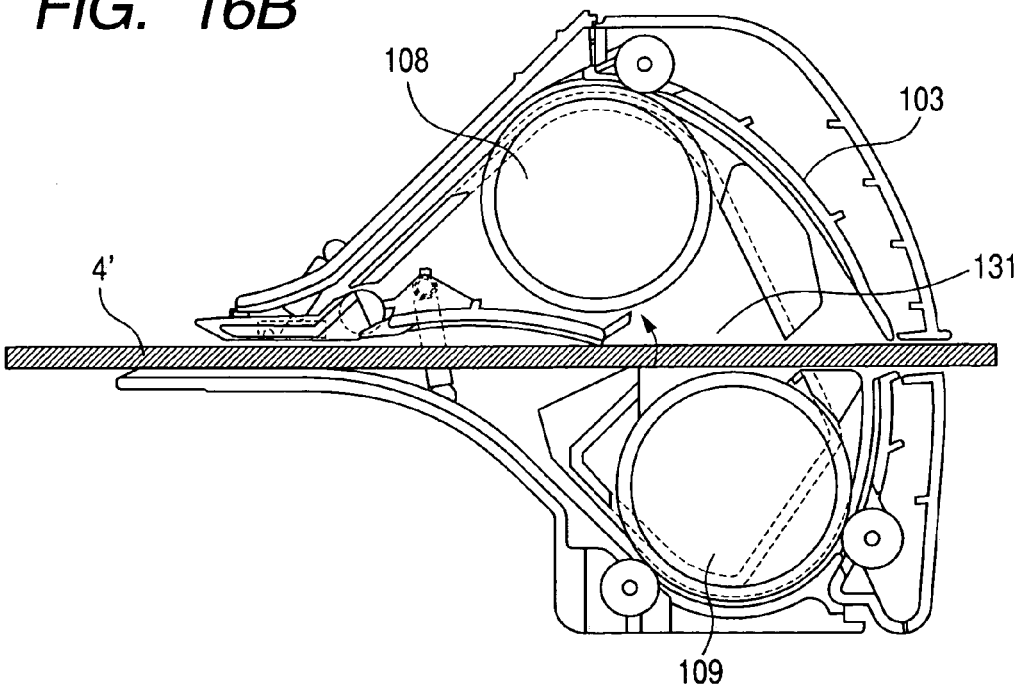

FIGS. 16A and 16B are schematic side sectional views describing the operation of the switching flap 104.

FIG. 16A shows the state in the case of performing the automatic two-sided recording by using the aforementioned normal recording paper. In this case, the switching flap spring 105 continues to energize the switching flap 104 to the stopper against suppressing strength of the recording paper 4 so that the recording paper 4 is guided to the passing path for inverting it.

FIG. 16B shows the state in the case of using the recording medium which is highly rigid. If a recording medium 4' which is highly rigid is conveyed to the sheet inverting portion 2, the recording medium 4' passes below the exit flap 106 to contact the switching flap 104. The switching flap spring 105 is set at the load to the extent of getting retracted by having the recording medium 4' which is highly rigid inserted and pushing the switching flap 104, and so it gets retracted by rotating counterclockwise in FIG. 16B following proceeding of the recording medium 4' which is highly rigid. For that reason, the recording medium 4' which is highly rigid is led to a retraction path 131 provided between the first two-sided roller 108 and the second two-sided roller 109. There is an opening at the position of the rear cover 103 equivalent to the retraction path 131, and so conveying is not restricted by interfering with the sheet inverting portion 2 even in the case of using the recording medium 4' which is long and highly rigid.

The purpose of the present invention is not thereby restricted, and it is not essential to provide the retraction path 131 between the first two-sided roller 108 and the second two-sided roller 109. Therefore, it is also possible to constitute it as follows.

Figure 17:
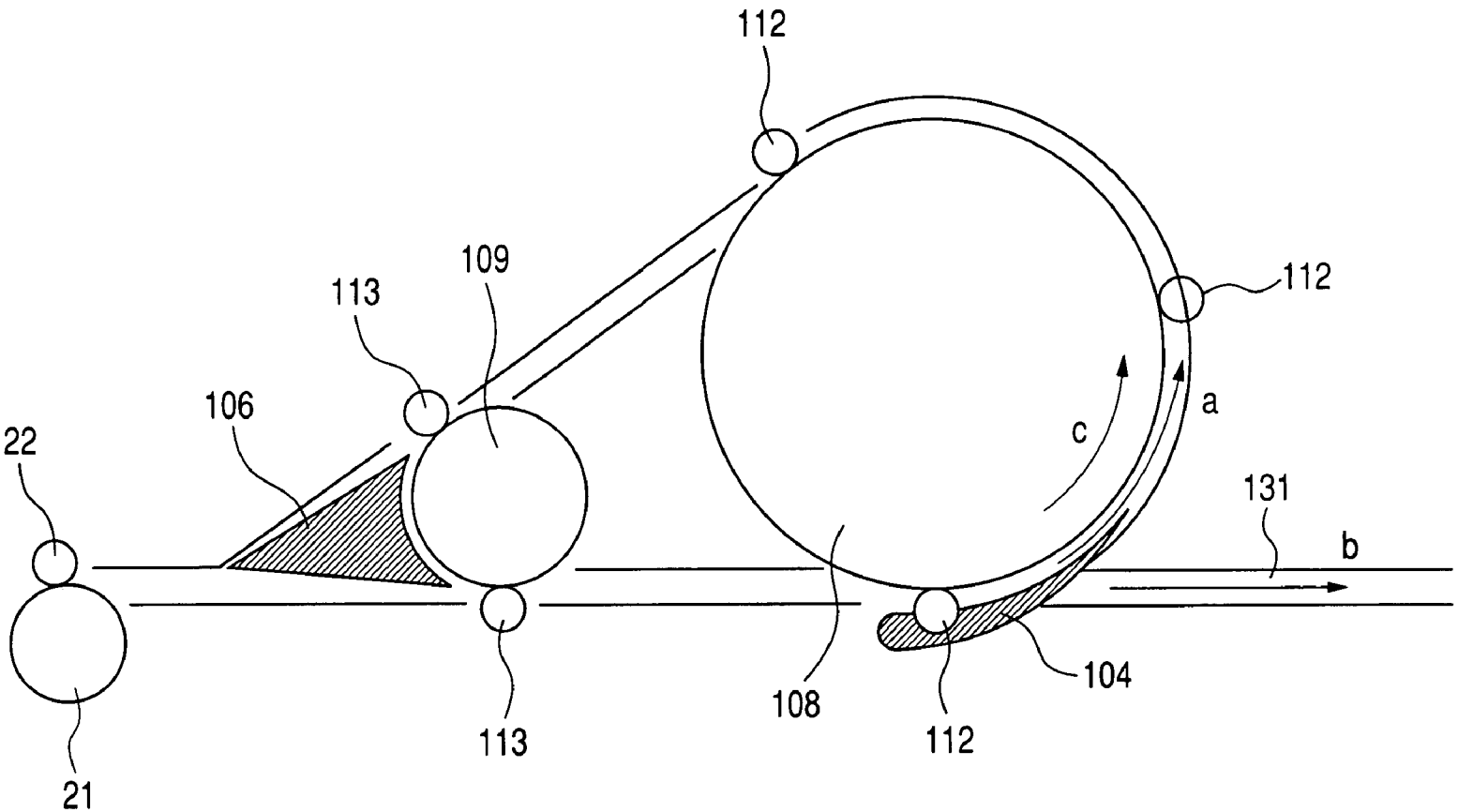
FIG. 17 is a schematic sectional view showing the sheet inverting portion constituted by placing a two-sided roller of a large diameter above an approximately horizontal path.

FIG. 17 is a schematic sectional view showing the sheet inverting portion constituted by placing the two-sided roller of a large diameter above an approximately horizontal path. As shown in FIG. 17, the switching flap 104 is energized at the position shown in FIG. 17 by the switching flap spring not shown, and the energizing force of the switching flap spring is set at the load at which the switching flap 104 is rotatable when contacted by the recording paper 4 of high rigidity. Therefore, in the case of the recording paper of low rigidity, the recording paper proceeds in the arrow a direction in FIG. 17 as the first two-sided roller 108 rotates in the arrow c direction in FIG. 17. In the case of the recorded medium of high rigidity, however, it pushes the switching flap 104 away and proceeds to the retraction path 131 in the arrow b direction in FIG. 17. Thus, even in the case of using the recording medium which is long and highly rigid, the conveying is not restricted by interfering with the sheet inverting portion 2.

Figure 18:
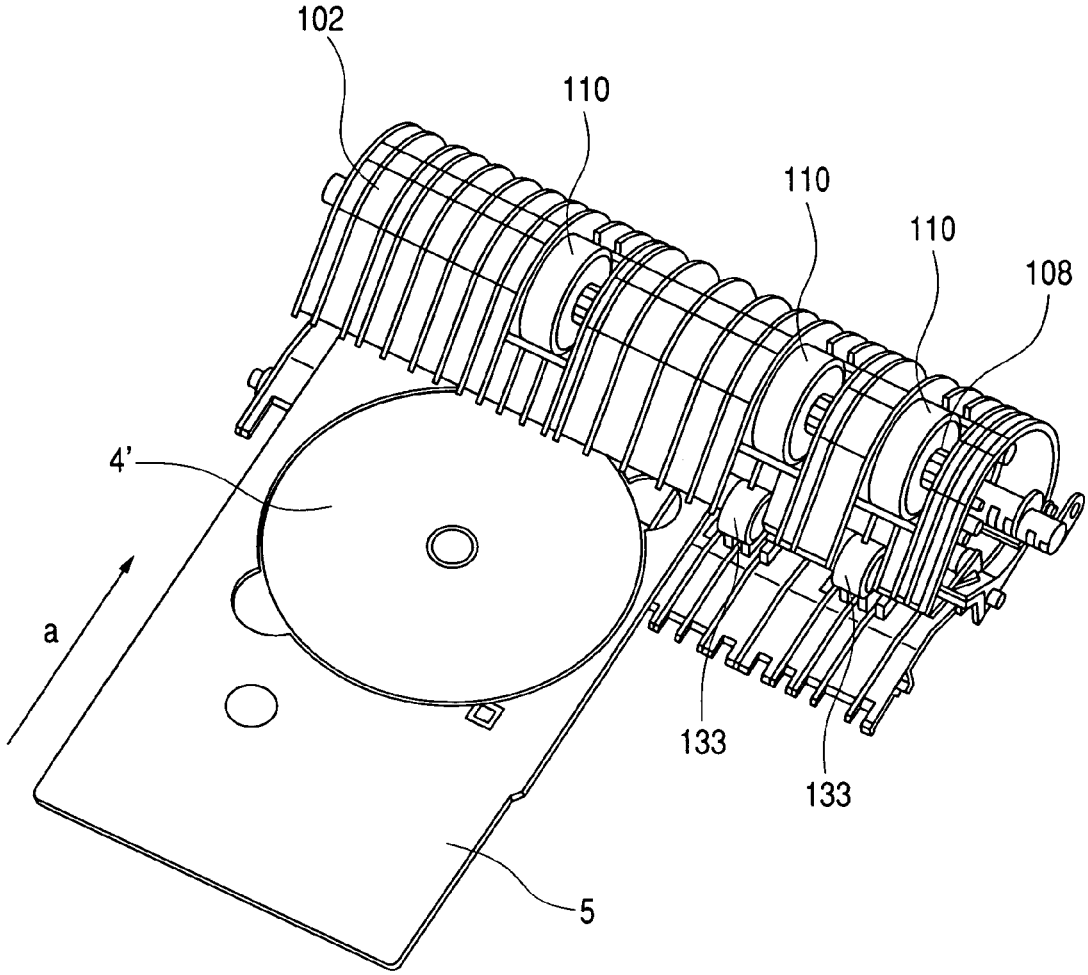
FIG. 18 is a schematic perspective view showing the sheet inverting portion constituted by placing the two-sided roller and approximately horizontal path in the same height direction.

FIG. 18 is a schematic perspective view showing the sheet inverting portion constituted by placing the two-sided roller and approximately horizontal path in the same height direction. As shown in FIG. 18, a third two-sided roller 133 of the sheet inverting portion 2 is placed at the same height as a loading tray 5 having the recording medium 4' (a CD or a DVD for instance) of highly rigidity loaded thereon. The switching flap 104 (refer to FIG. 17) forms the path on the left side of the third two-sided roller 133 at the same height as the third two-sided roller 133. Thus, a horizontal conveying route for conveying approximately on the horizontal the recording medium which is too highly rigid to be conveyed on the conveying route for inversion is provided at the same height as the nip portion constituted by an inversion roller provided in the conveying route for inversion.

The switching flap 104 is energized downward by the switching flap spring not shown, and the energizing force of the switching flap spring is set at the load at which the switching flap 104 is rotatable when contacted by the recording medium of high rigidity. In the case of the recorded medium of low rigidity, it continues to energize the switching flap 104 to the stopper against the suppressing strength of the recording paper so that the recording paper is guided to the passing path for inverting it. In the case where the recording paper of high rigidity is inserted, the switching flap 104 rotates and gets retracted according to the proceeding of the recording medium of high rigidity, and so it forms the approximately horizontal path in the arrow a direction shown in the drawing so that the recording medium of high rigidity proceeds in the arrow a direction shown in the drawing.

As an advantage of such a configuration, it can be pointed out that, even when the distance between the paper feed roller 21 and the two-sided rollers 108, 109 is too long to carry a small recording medium, it is possible to carry the small recording medium by placing the third two-sided roller 133 between them. The purpose of the present invention is not limited to loading the recording medium of high rigidity on the loading tray 5, but it is also possible to have the switching flap 104 rotated by the recording medium of high rigidity itself.

Next, a description will be given as to a roller drive mechanism of the sheet inverting portion 2.

Figure 19:
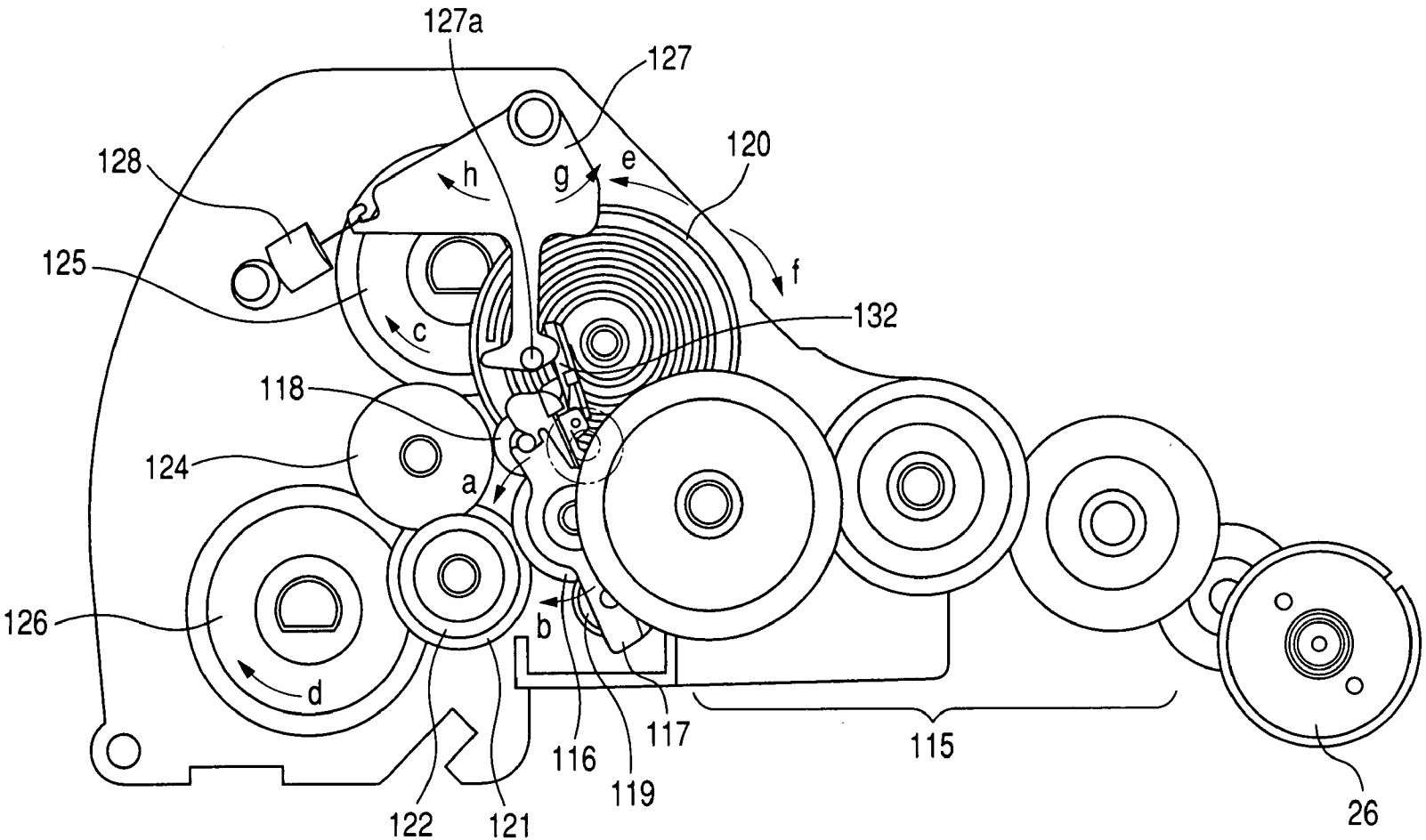
FIG. 19 is a schematic side sectional view showing a roller drive mechanism of the sheet inverting portion viewed from an opposite side in FIG. 2.

FIG. 19 is a schematic side sectional view showing the roller drive mechanism of the sheet inverting portion 2 viewed from the opposite side in FIG. 2.

In FIG. 19, reference numeral 115 denotes a two-sided transmission gear row for transmitting the power from the LF motor 26 to a two-sided sun gear 116, 116 denotes the two-sided sun gear located at the center of a two-sided pendulum arm 117, 117 denotes the two-sided pendulum arm swingable with the two-sided sun gear 116 as a rotation center, 118 denotes a first two-sided planet gear rotatably mounted on the two-sided pendulum arm 117 and engaging with the two-sided sun gear 116, 119 denotes a second two-sided planet gear rotatably mounted on the two-sided pendulum arm 117 and engaging with the two-sided sun gear 116 likewise, 120 denotes a spiral groove gear engaging with the two-sided sun gear 116 via an idler, 121 denotes a first inverting delay gear engaging with the two-sided planet gears 118 and 119, 122 denotes a second inverting delay gear coaxial with the first inverting delay gear 121, 124 denotes a two-sided roller idler gear 124 for linking two two-sided roller gears 125 and 126, 125 denotes a first two-sided roller gear fixed to the first two-sided roller 108, 126 denotes a second two-sided roller gear fixed to the second two-sided roller 109, 127 denotes a stop arm for swinging in engagement with the groove of the spiral groove gear 120, 128 denotes a stop arm spring for centering the stop arm 127, and 132 denotes a two-sided pendulum arm spring mounted on the two-sided pendulum arm 117.

As previously mentioned, the driving force of the sheet inverting portion 2 is obtained from the LF motor 26 for driving the paper feed roller 21 according to this embodiment. This configuration is suitable because it is thereby possible to synchronize timing in starting and stopping the operation and conveying speed of the recording paper almost completely when the paper feed roller 21 and the first two-sided roller 108 or second two-sided roller 109 carry the recording paper in cooperation.

The driving force from the LF motor 26 is transmitted to the two-sided sun gear 116 via the two-sided transmission gear row 115. The two-sided sun gear 116 has the swingable two-sided pendulum arm 117 mounted thereon, and the two-sided pendulum arm 117 further has the first two-sided planet gear 118 and second two-sided planet gear 119 mounted thereon. As an adequate frictional force is exerted between the two-sided sun gear 116 and the two-sided pendulum arm 117, the two-sided pendulum arm 117 swings following the rotation direction of the two-sided sun gear 116.

Here, if the direction for rotating the LF motor 26 in the direction in which the paper feed roller 21 conveysconveys the recording paper toward ejection is the normal direction, and the direction for conveying the recording paper to the sheet inverting portion 2 side is the reverse direction, the two-sided sun gear 116 rotates in the arrow a direction in FIG. 19 when the LF motor 26 rotates in the normal direction. The two-sided pendulum arm 117 also swings basically in the arrow a direction in FIG. 19 in conjunction with the rotation of the two-sided sun gear 116. Then, the first two-sided planet gear 118 engages with and rotates the two-sided roller idler gear 124. In conjunction with the rotation of the two-sided roller idler gear 124, the first two-sided roller gear 125 rotates in the arrow c direction in FIG. 19 and the second two-sided roller gear 126 rotates in the arrow d direction in FIG. 19. The arrows c and d in FIG. 19 are the directions in which the first two-sided roller 108 and second two-sided roller 109 carry the recording paper in the sheet inverting portion 2 respectively.

If the LF motor 26 rotates in the reverse direction, the two-sided sun gear 116 rotates in the arrow b direction in FIG. 19. The two-sided pendulum arm also swings in the arrow b direction in FIG. 19 in conjunction with the rotation of the two-sided sun gear 116. Then, the second two-sided planet gear 119 engages with the first inverting delay gear 121. The first inverting delay gear 121 and second inverting delay gear 122 mutually have projections jutting out of opposed thrust faces. And if the second inverting delay gear 122 is fixed, the projections play a role of an engaging clutch when the first inverting delay gear 121 is rotated once.

Before the second two-sided planet gear 119 engages with the first inverting delay gear 121, the first inverting delay gear 121 and second inverting delay gear 122 are energized in the direction for separating the projections by an inverting delay gear spring (not shown) for exerting a relative energizing force between the first inverting delay gear 121 and second inverting delay gear 122. Therefore, the second inverting delay gear 122 starts the rotation after the first inverting delay gear 121 starts the rotation and approximately rotates once. This period from the start of reversal of the LF motor 26 to the start of rotation of the second inverting delay gear 122 is a delay period in which the first two-sided roller 108 and second two-sided roller 109 are stopped.

If the second inverting delay gear 122 rotates, the first two-sided roller gear rotates in the arrow c direction in FIG. 19 and the second two-sided roller gear rotates in the arrow d direction in FIG. 19 via the two-sided roller idler gear 124. They are the same directions as those on rotating the LF motor 26 in the normal direction. With such a mechanism, it is possible, irrespective of the rotation direction of the LF motor 26, to rotate the first two-sided roller 108 and second two-sided roller 109 constantly in the conveying direction of the recording paper.

Here, a description will be given as to the action of the spiral groove gear 120. The spiral groove gear 120 is the one having a gear face formed on its outer circumference and having a cam with endless tracks provided on its innermost and outermost circumferences and a spiral groove cut thereon formed on one end face. According to this embodiment, the spiral groove gear 120 is directly linked to the two-sided sun gear 116 via the idler gear, and so it rotates in the same direction as the two-sided sun gear 116 in synchronization. The spiral groove gear 120 has a follower pin 127*a* as a part of the stop arm 127 engaged with its groove, and so the stop arm 127 swings in conjunction with the rotation of the spiral groove gear 120. For instance, if the spiral groove gear 120 rotates in the arrow e direction in FIG. 19, the follower pin 127*a* is drawn in its inner circumference so that the stop arm 127 swings in the arrow g direction in FIG. 19. Even if the spiral groove gear 120 continues to rotate as-is in the arrow e direction in FIG. 19, the follower pin 127*a* enters in the endless track in the innermost circumference so that the stop arm 127 stops at a predetermined position.

Inversely, if the spiral groove gear 120 rotates in the arrow f direction in FIG. 19, the follower pin 127*a* moves toward the outer circumference so that the stop arm 127 swings in the arrow h direction in FIG. 19. Likewise, if the spiral groove gear 120 continues to rotate in the arrow f direction in FIG. 19, the follower pin 127*a* enters in the endless track in the outermost circumference so that the stop arm 127 stops at the predetermined position. The stop arm 127 has the stop arm spring 128 mounted thereon for the sake of centering on a neighborhood of a moving range center of the stop arm 127 as the center in order to move smoothly to the spiral groove from the endless tracks in the outermost and innermost circumferences when the rotation direction of the spiral groove gear 120 changes.

The stop arm 127 for performing such an operation acts on the two-sided pendulum arm spring 132 mounted on the two-sided pendulum arm 117. The two-sided pendulum arm spring 132 is an elastic member mounted on the two-sided pendulum arm 117 and extending in the direction of the stop arm 127. The end of the two-sided pendulum arm spring 132 is constantly in a more central direction of the spiral groove gear 120 than the stop arm 127.

Such a positional relationship provides the following action when the LF motor 26 rotates. To be more specific, when the LF motor 26 rotates in the reverse direction, conveysconveys the recording paper 4 to the sheet inverting portion 2 and the recording paper 4 is turned over and returns to the paper feed roller 21, the stop arm 127 rotates on the endless track in the outermost circumference against the spiral groove gear 120. Thereafter, when the LF motor 26 is rotated to record on the backside, the stop arm 127 moves toward the inner circumference of the spiral groove gear 120. While the LF motor 26 is rotating, the two-sided pendulum arm 117 is transmitting the power by swinging in the arrow a direction in FIG. 19, and so the stop arm 127 contacts the two-sided pendulum arm spring 132 on its way to the inner circumference.

If the LF motor 26 is further rotated, the stop arm 127 further moves toward the inner circumference to elastically deform the two-sided pendulum arm spring 132. Therefore, the position of the two-sided pendulum arm 117 is decided by a balance of the forces, that is, the force exerted when tooth planes of the first two-sided planet gear 118 and two-sided roller idler gear 124 engage, the force for swinging the two-sided pendulum arm 117 in the arrow a direction in FIG. 19 and a repulsive force of the two-sided pendulum arm spring 132. According to this embodiment, the repulsive force of the two-sided pendulum arm spring 132 is set small. Therefore, even if the stop arm 127 is at the position on the endless track in the innermost circumference, only the two-sided pendulum arm spring 132 is elastically deformed, and power transmission between the first two-sided planet gear 118 and two-sided roller idler gear 124 is continued.

Even if the operation of the LF motor 26 is in a stopped state while repeating the rotation and stop with intermittent driving, the first two-sided planet gear 118 and two-sided roller idler gear 124 keep their tooth planes engaged and so they will not go out of the engagement. However, if the backside recording of the recording paper 4 is finished and drive transmission to the sheet inverting portion 2 becomes unnecessary, it is preferable to sever the drive so as to reduce the load of the LF motor 26. Therefore, the following should be performed in the case where the drive transmission should be severed. To be more specific, the LF motor 26 is rotated just a little in the reverse direction in the state in which the stop arm 127 is on the endless track in the innermost circumference and the two-sided pendulum arm spring 132 is elastically deformed. Thus, a torque is provided in the direction for disengaging the tooth planes in the state of keeping the two-sided pendulum arm 117 from swinging in the arrow b direction in FIG. 19 with the repulsive force of the two-sided pendulum arm spring 132 by the engagement between the tooth planes of the first two-sided planet gear 118 and two-sided roller idler gear 124. Therefore, the two-sided pendulum arm 117 rotates at a dash in the arrow b direction in FIG. 19.

Once the two-sided pendulum arm 117 rotates in the arrow b direction in FIG. 19, the two-sided pendulum arm spring 132 which has been elastically deformed returns to its original state. Thus, even if the LF motor 26 is rotated in the normal direction, the two-sided pendulum arm spring 132 and stop arm 127 interfere so that the two-sided pendulum arm 117 cannot swing to the position at which the first two-sided planet gear 118 and two-sided roller idler gear 124 engage. Therefore, in this state, the driving force is not transmitted to the two-sided pendulum arm 117 in the sheet inverting portion 2 and thereafter without going through a predetermined amount of the reversal of the LF motor 26. The drive up to the two-sided pendulum arm 117 is merely rotating the gear rows, and so the load applied to the LF motor 26 is slight, which makes almost no difference from the case of having no sheet inverting portion 2. In the case where the LF motor 26 is reversed from the state in which the stop arm 127 is on the endless track in the innermost circumference, no action is exerted between the two-sided pendulum arm spring 132 and the stop arm 127 so that the driving force can be transmitted to the first inverting delay gear 121 as previously mentioned.

Next, a description will be given as to detailed operations of the drive mechanism of the rollers shown in the sheet inverting portion 2. FIGS. 20A to 20F are schematic side sectional views showing the operating states of the rollers of the sheet inverting portion 2 shown in FIG. 19. FIGS. 21A and 21B are flowcharts of the automatic two-sided recording. Hereafter, the operations of the automatic two-sided recording will be described by using the flowcharts.

If the automatic two-sided recording starts, the feed of the recording paper 4 is performed (S1). For instance, the recording paper 4 is supplied to the paper feed roller 21 from the main ASF 37 and so on. Next, the recording is performed on the right face of the recording paper 4 (S2). This is the same operation as that in the case of recording only on one side. The drive mechanism of the rollers in this case is in the state shown in FIG. 20A.

Figure 20A:
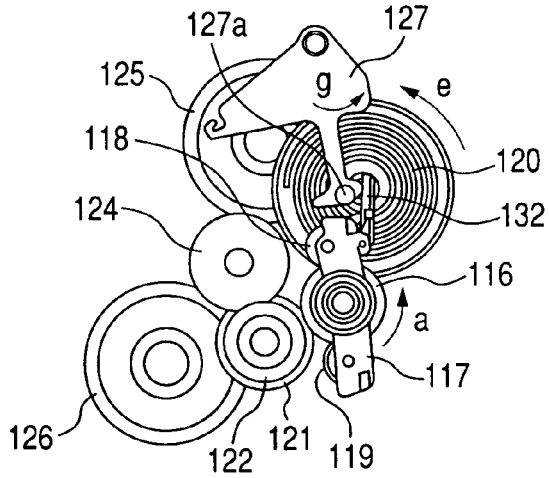
FIGS. 20A, 20B, 20C, 20D, 20E and 20F are schematic side sectional views showing the operating states of the roller and so on of the sheet inverting portion shown in FIG. 19.

FIG. 20A shows the state in which the LF motor 26 is rotating in the normal direction after initializing the drive mechanism of the sheet inverting portion 2. To be more specific, it shows the state during the right face recording on the automatic two-sided recording or during normal recording operation without using the automatic two-sided recording. As the follower pin 127*a* of the stop arm 127 is on the endless track in the innermost circumference of the spiral groove gear 120, the two-sided pendulum arm 117 contacts the stop arm 127 when trying to swing in the arrow a direction in FIGS. 20A to 20F so that it cannot rotate any longer and the first two-sided planet gear 118 cannot engage with the two-sided roller-idler gear 124. Therefore, the driving force from the LF motor 26 is not transmitted to the first two-sided roller gear 125 and second two-sided roller gear 126. In this state, the pressure of the first two-sided pinch roller 112 or second two-sided pinch roller 113 is exerted so that the first two-sided roller 108 or second two-sided roller 109 having generated the rotation resistance does not rotate, resulting in a small amount of load imposed on the LF motor 26.

Next, on finishing the right face recording, it is checked whether or not the back end of the recording paper has been detected by the PE sensor 67 (S3). In this case, if the PE sensor 67 is still indicating that "the recording paper 4 exists," it has not detected the back end of the right face of the recording paper 4 yet. Therefore, the LF motor 26 is rotated as-is in the normal direction so as to move it to a position p2 at which the back end of the right face of the recording paper 4 has further proceeded a little after passing the PE sensor lever 66 (S4)

Next, the length of the recording paper 4 is calculated from the amount of the recording paper 4 conveyed since the PE sensor 67 detected the end of the right face until it detected the back end thereof (S5). As previously mentioned, in the case where the length of the recording paper 4 is shorter than a predetermined length L1, it will not be able to reach the roller while conveying it from the paper feed roller 21 to the second two-sided roller 109 or from the first two-sided roller 108 to the paper feed roller 21, and so it should be excluded from subjects of the automatic two-sided recording operation. In the case where the length of the recording paper 4 is longer than a predetermined length L2, the recorded faces of the recording paper mutually intersect in the passing path from the paper feed roller 21 to the sheet inverting portion 2, and so it should also be excluded from the subjects of the automatic two-sided recording. In the case where exclusion from the subjects of the automatic two-sided recording is determined under these conditions, the LF motor 26 is rotated in the normal direction so as to eject the recording paper 4 as-is (S6).

In the case where the conditions are met, the lift mechanisms are set at the third position and the pinch roller 22 is released (S7).

Next, it is checked whether or not the back end of the front face of the recording paper 4 has already been conveyed further downstream than a position p1 near the pinch roller 22 (S8). In the case where the back end of the front face of the recording paper 4 has already been conveyed to the downstream side, the LF motor 26 is rotated to back-feed it until it comes to p1 so as to securely hold it between the paper feed roller 21 and the pinch roller 22 on returning the pinch roller 22 to the press-contacting state (S9). The drive mechanism of the rollers at this time is in the state shown in FIG. 20B. It is desirable, as to the steps 2 to 8, to avoid a stop of the operation as much as possible and perform the step 9 before the recording paper 4 gets deformed as previously mentioned. In the case where the back end of the front face is further upstream than the position p1, it is possible to securely hold the recording paper 4 by press-contacting the pinch roller 22 as-is. therefore, it moves on to a step 10 as-is.

Figure 20D:
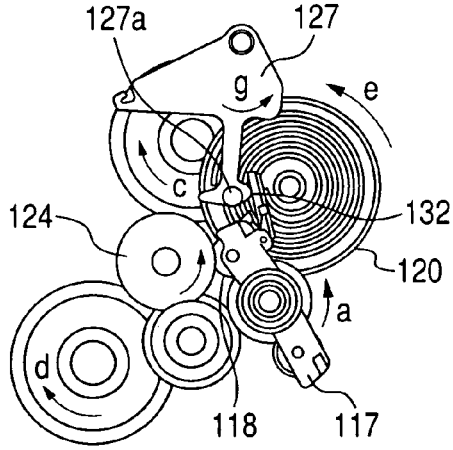
Figure 20B:
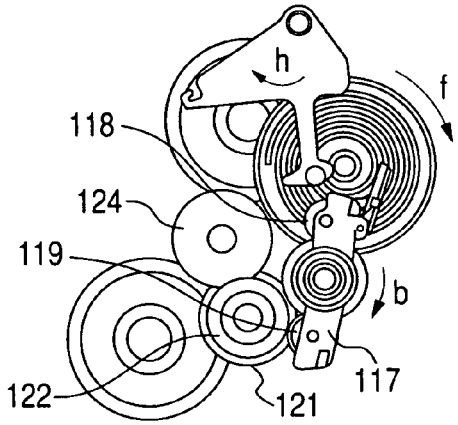
Figure 20E:
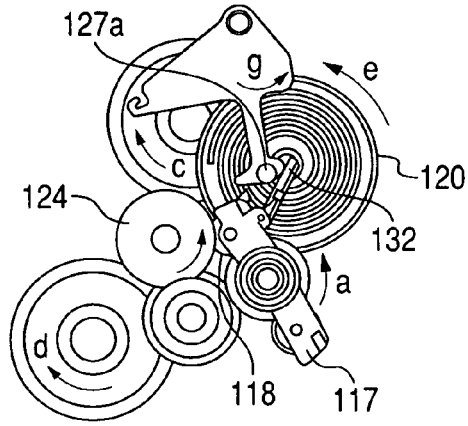

FIG. 20B shows the state immediately after the LF motor 26 starts the reversal. To be more specific, it shows the state immediately after the back-feed starts after finishing the front face recording of the automatic two-sided recording or in the case of reversing the LF motor 26 for the sake of adjusting a starting volume after the feed from the main ASF 37. In this case, nothing prevents the two-sided pendulum arm 117 from swinging in the arrow b direction in FIGS. 20A to 20F so that the second two-sided planet gear 119 engages with the first inverting delay gear 121. In conjunction therewith, the first inverting delay gear 121 starts to rotate. Until it rotates once, the driving force is not transmitted to the second inverting delay gear 122, and so the two-sided roller idler gear 124 does not rotate and the first two-sided roller 108 and second two-sided roller 109 do not operate. Thus, the load imposed on the LF motor 26 is still a small amount in this sate.

Such a state is set up because, as there is a distance between the paper feed roller 21 and the second two-sided roller 109 when back-feeding the recording paper 4 on the automatic two-sided recording, the second two-sided roller 109 does not need to rotate until the end of the recording paper 4 reaches the second two-sided roller 109. As previously mentioned, it is also intended to prevent the first two-sided roller 108 and second two-sided roller 109 from rotating improperly on adjusting the starting volume of the recording paper when recording.

Next, a standby time until the ink recorded on the right face of the recording paper 4 dries is provided (S10). As the drying time varies due to some factors as previously mentioned, a drying standby time t1 may be a variable parameter. To be more precise, t1 is decided by considering the conditions such as the kind of recording paper, kind of ink, overstriking method of the ink, overstriking amount of the ink per unit area, temperature and humidity of the environment, and wind speed of the environment.

Next, the lift mechanisms are set at the fourth position (S11). Thus, the recording paper 4 is held between the paper feed roller 21 and the pinch roller 22 again.

Next, a drying standby time t2 is provided (S12). It does not have to be used in the case where the drying standby time t1 is executed in the step 10. In that case, it is possible to move on to a next step by rendering it as t2=0. The drying standby time t2 is provided, for instance, in the case where no recording operation is performed and a margin exists at the back end of the recording paper 4. In that case, it has no adverse effect to render it as t1=0 in the step 10 and exert control to immediately press-contact the pinch roller 22 to the margin. If immediately back-fed as-is to carry the recording paper 4, however, the ink before drying may be transferred to the pinch roller 22. Therefore, the drying standby time t2 should be provided here.

The back end of the front face of the recording paper 4 is in the free state during the steps 7 to 11, that is from releasing the pinch roller 22 from the recording paper 4 to press-contacting the pinch roller 22 again. Thus, there is a possibility that it may be curled and float. For this reason, if the carriage 13 is moved in this state, the recording paper 4 may get stuck to cause the jam or rasp the record head 11. Therefore, the carriage 13 is controlled not to operate in the range where the recording paper passes during the steps 7 to 11.

Next, the LF motor 26 is rotated in the reverse direction, and the recording paper is back-fed just by a predetermined amount X1 (S13). In this step, the recording paper 4 is conveyed to the sheet inverting portion 2 so as to be inverted. When this step is finished, the backside end is returned to a location a little before the paper feed roller 21. The drive mechanism of the rollers in this case is in the state shown in FIG. 20C.

Figure 20C:
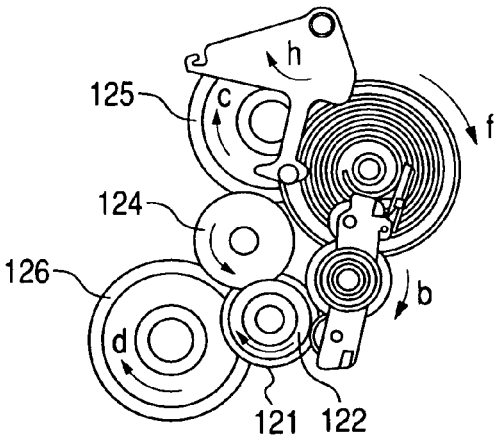
Figure 20F:
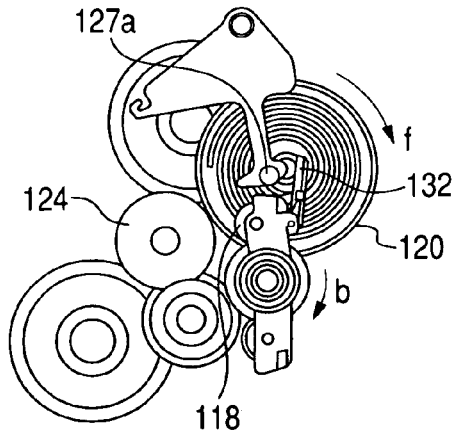
Figure 21:
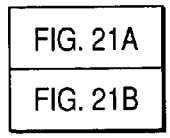
FIG. 21 is comprised of FIGS. 21A and 21B showing flowcharts of operation sequences of automatic two-sided recording.
Figure 21A:
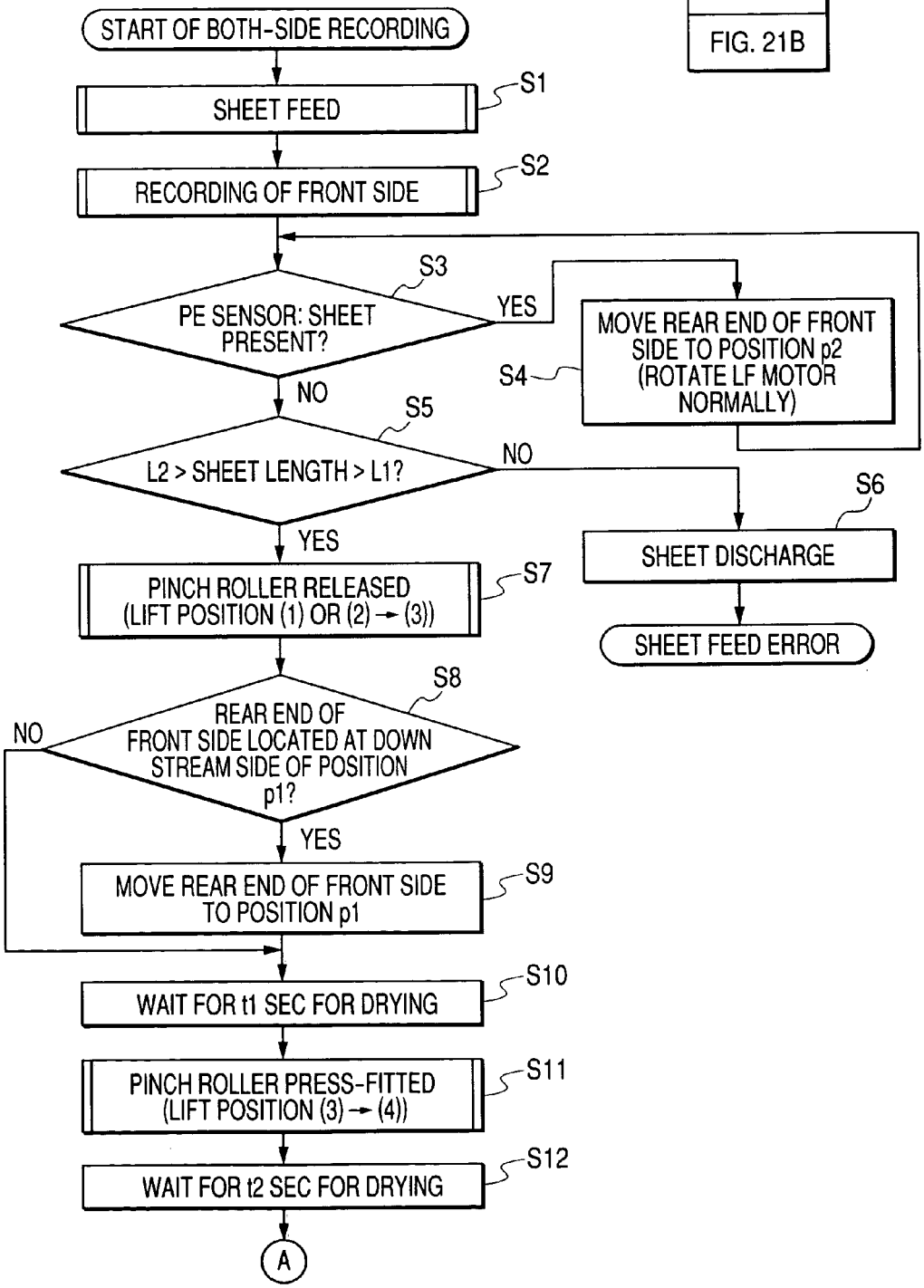
Figure 21B:
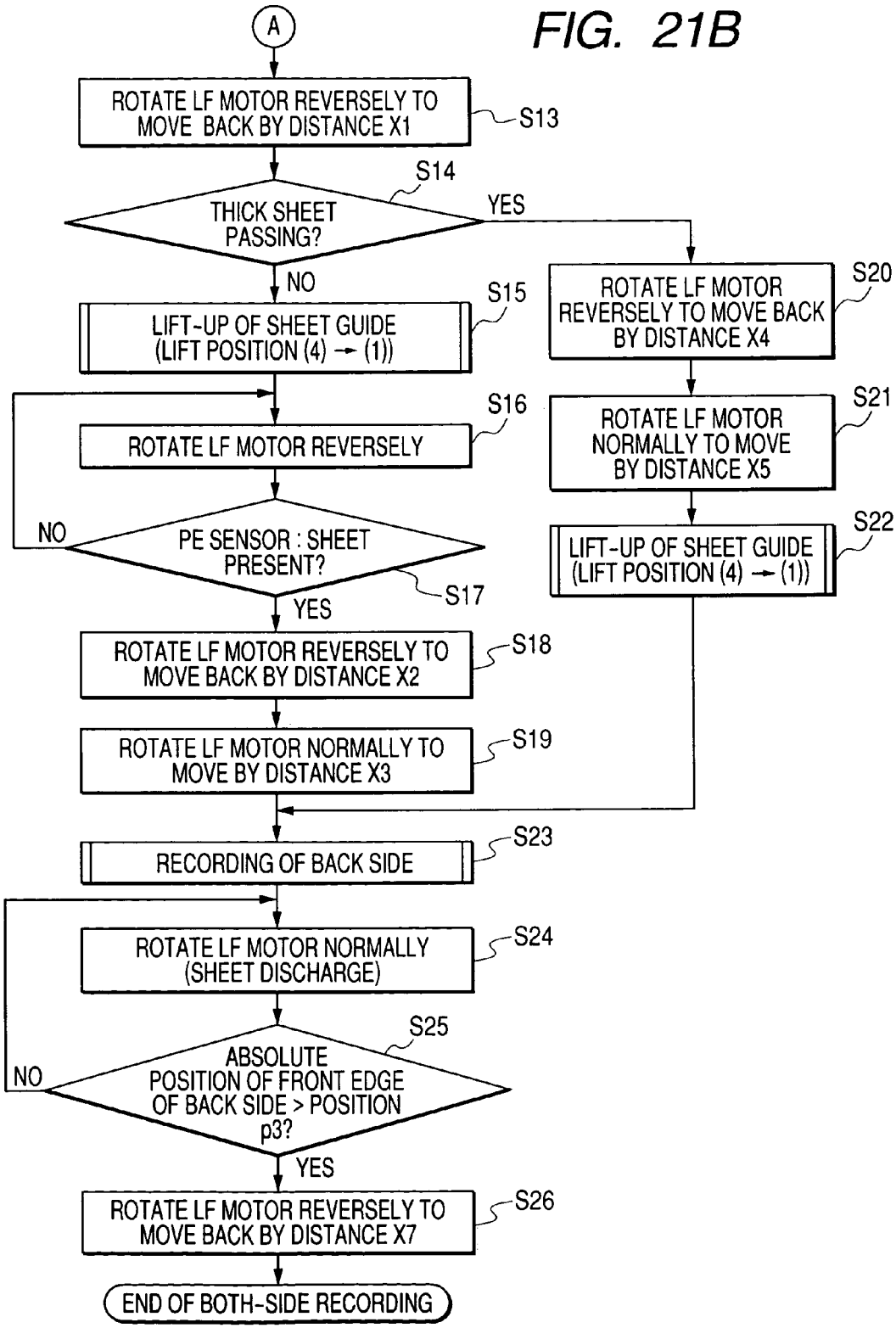

FIG. 20C shows the state in which the LF motor 26 is further continuously reversed. To be more specific, it is the state in which the recording paper 4 is back-fed and inverted by the sheet inverting portion 2. From the state in FIG. 20B and thereafter, if the first inverting delay gear 121 approximately rotates once, the projection jutting out in a thrust direction of the first inverting delay gear 121 engages with the projection of the second inverting delay gear 122 provided oppositely. And the first inverting delay gear 121 and second inverting delay gear 122 start rotating as one. If the second inverting delay gear 122 starts rotating, the two-sided roller idler gear 124, first two-sided roller gear 125 and second two-sided roller gear 126 rotate because the second inverting delay gear 122 is constantly engaged with the two-sided roller idler gear 124. Thus, the first two-sided roller 108 rotates in the arrow c direction in FIGS. 20A to 20F, and the second two-sided roller 109 rotates in the arrow d direction in FIGS. 20A to 20F respectively.

Next, a description will be given as to so-called registration for having the backside end of the recording paper held at the nip portion between the paper feed roller 21 and pinch roller 22. First, control is switched according to whether the recording paper 4 currently in use is relatively thin recording paper of relatively low rigidity or relatively thick recording paper of relatively high rigidity, that is, whether or not the rigidity of the recording paper 4 is smaller than a predetermined value in other words (S14).

The rigidity of the recording paper 4 may be determined according to the kind of the recording paper set by the user with a printer driver for instance. The printer driver for driving the recording apparatus operates on the host apparatus 308 (refer to FIG. 3) connected to the recording apparatus for instance. And the printer driver associates a plurality of kinds of recording paper selectable by the user with the rigidity thereof. The rigidity (or stiffness) measured by a rigidity meter of Gurley method may be used as the rigidity of the recording paper. For instance, in the case where the recording paper of which rigidity according to the rigidity meter of Gurley method is smaller than 1000 mgf (9.807 mN) is selected as the recording paper for performing the recording on the printer driver, the control portion for controlling the recording apparatus determines that the rigidity of the recording paper 4 is smaller than the predetermined value.

The rigidity of the recording paper 4 may also be determined by using thickness detection means for detecting the thickness of the recording paper 4.

Here, the control is divided into two because behavior of the recording paper 4 when a loop is created by deforming the recording paper 4 is different according to the rigidity of the recording paper 4.

Figure 22A:
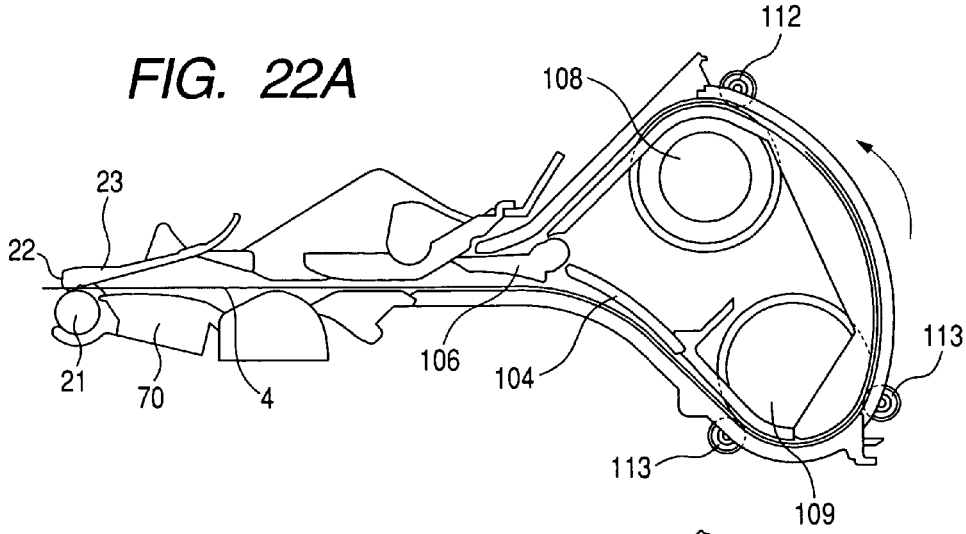
FIGS. 22A, 22B and 22C are schematic side sectional views for describing a registration operation of a leading end of the backside in the case of using relatively thin recording paper of relatively weak rigidity.
Figure 22B:
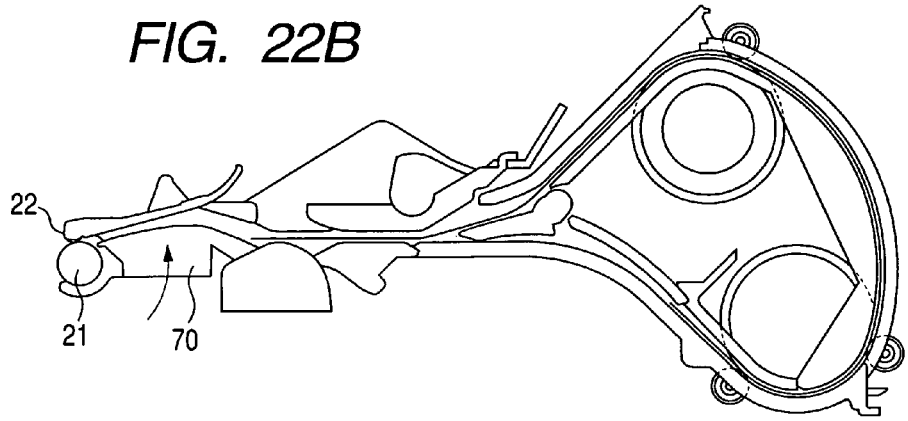
Figure 22C:
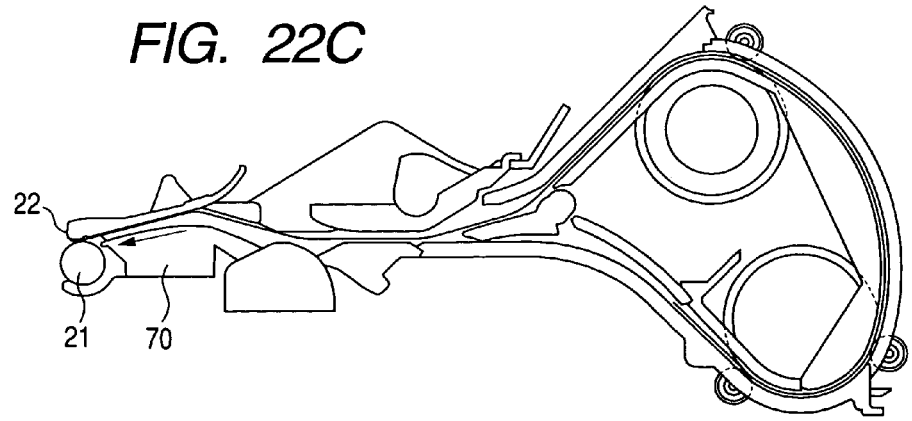

First, a description will be given as to the case of the relatively thin recording paper of low rigidity. FIGS. 22A to 22C are schematic side sectional views for describing the registration operation of the end of the backside in the case of using the relatively thin recording paper 4 of low rigidity.

As shown in FIG. 22A, the recording paper 4 is inversely conveyed by the reversal of the LF motor 26 in the step 13 as previously mentioned. On finishing the step 13, the backside end of the recording paper 4 is returned approximately to a neighborhood of the passing guide 70. In the case of the thin recording paper, the lift mechanisms are operated and moved to the first position (S15). The passing guide 70 is thereby raised.

FIG. 22B is a diagram showing the state in which the step 15 is finished. As previously mentioned, the pinch roller 22 has its center placed on the first ejection roller 30 side with a little offset against the center of the paper feed roller 21.

Therefore, the nip portion between the paper feed roller 21 and pinch roller 22 have a little angle to an approximately horizontal face on which the recording paper 4 is conveyed. It is possible, by returning the passing guide 70 to a raised position before the registration operation, to lead the backside end of the recording paper 4 smoothly to the inclined nip portion.

Next, the LF motor 26 is further reversed, and the recording paper 4 is further conveyed in the direction of the paper feed roller 21 (S16). Next, the backside end of the recording paper 4 is detected by the PE sensor 67 (S17).

If the backside end of the recording paper 4 is detected, the recording paper 4 is conveyed over a distance X2 which is a little longer than the distance from a backside end position detected by the PE sensor 67 to the paper feed roller 21 (S18). Thus, the backside end of the recording paper 4 reaches the nip portion between the paper feed roller 21 and pinch roller 22, and a portion conveyed extra forms the loop as the recording paper 4 gets deformed. Though not shown in FIGS. 21A and 21B, the standby operation is performed during the conveying in the step 18 as a measure against the jam of a backside end 4*a* with adequate values decided according to the overstriking amount of the ink and recording position on the right face recording so as to curl the recording paper 4 downward.

FIG. 22C is a diagram showing the state in which the step 18 is finished. The clearance in the height direction of the passing path is reduced by placing the passing guide 70 at the raised position. However, the loop is easily formed because the rigidity of the recording paper 4 is relatively low. If the recording paper 4 is pushed by the loop, it completes so-called registration operation wherein the backside end of the recording paper 4 becomes parallel with the paper feed roller 21 by following the nip portion between the paper feed roller 21 and pinch roller 22 continuously reversing.

Next, the LF motor 26 is rotated in the normal direction, and the backside end of the recording paper 4 is held at the nip portion and is conveyed just by a predetermined distance X3 so as to complete preparations for starting the backside recording (S19).

Figure 23A:
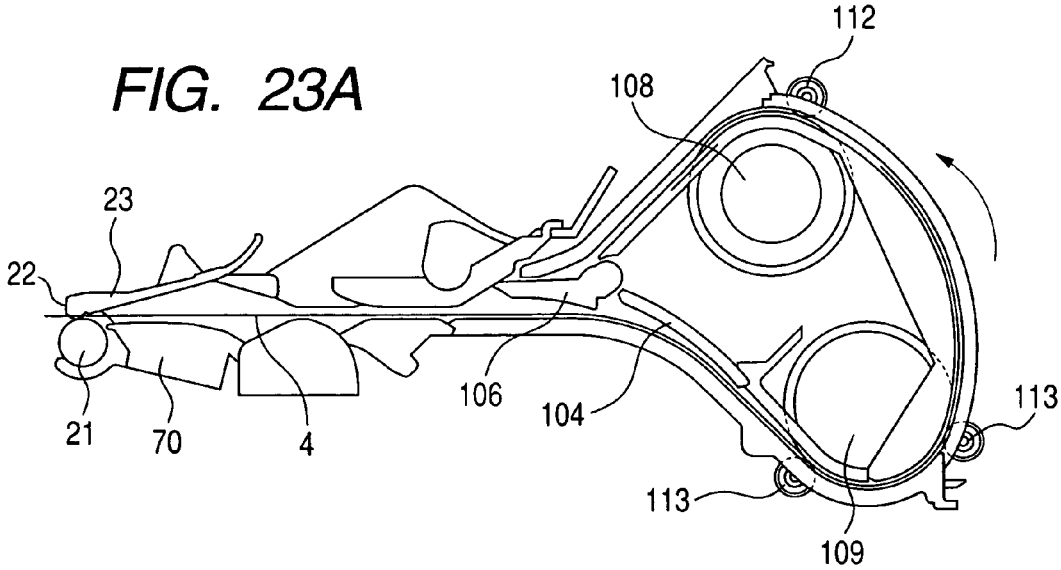
FIGS. 23A, 23B and 23C are schematic side sectional views for describing the registration operation of the end of the backside in the case of using relatively thick recording paper of relatively strong rigidity.
Figure 23B:
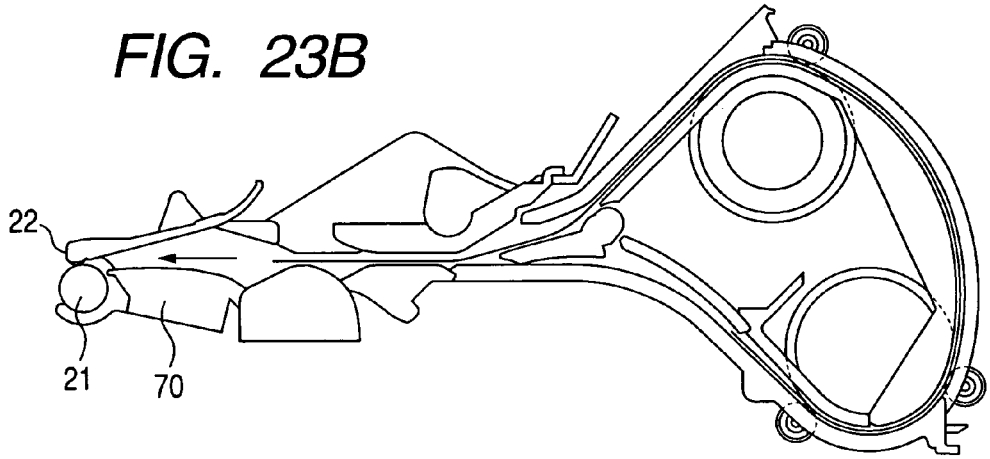
Figure 23C:
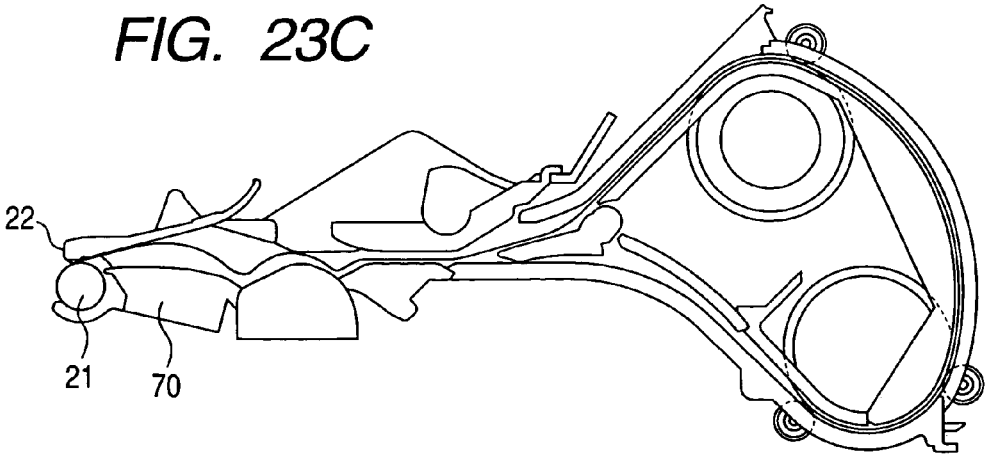

Next, a description will be given as to the case of the relatively thick recording paper of high rigidity. FIGS. 23A to 23C are schematic side sectional views for describing the registration operation of the end of the backside in the case of using the relatively thick recording paper of high rigidity. FIG. 23A shows the state in the middle of the step 13 as in FIG. 22A, and FIG. 23B shows the state in which the step 13 is finished.

Next, the passing guide 70 rotates the LF motor 26 in the reverse direction as-is in a descending condition, and conveys the recording paper 4 over a distance X4 which is a little longer than the distance from the backside end of the recording paper 4 to a nip of the paper feed roller 21 at the position of stopping in the step 13 (S20). Thus, as in the case of the relatively thin recording paper 4, the backside end of the recording paper 4 reaches the nip portion of the paper feed roller 21 which is reversing, and the paper further pushed in forms the loop. Therefore, the backside end of the recording paper 4 becomes parallel with the paper feed roller 21 so as to complete the registration operation. FIG. 23C shows the state in which the step 20 is finished.

Next, the LF motor 26 is reversed, and the backside end of the recording paper 4 is held at the nip portion and is conveyed over a predetermined distance X5 so as to be ready for a start of the backside recording (S21).

In the step 19 or 21, the LF motor 26 reversing till then rotates in the normal direction. At this time, the two-sided pendulum arm 117 swings in the arrow a direction in FIGS. 20A to 20F. Then, the second two-sided planet gear 119 is disengaged from the first inverting delay gear 121. When the LF motor 26 is reversing, the first inverting delay gear 121 is engaged with the second inverting delay gear 122 by the projections, and also the inverting delay gear spring (not shown) which is the torsion coil spring sandwiched between them is in a compresses state. However, the first inverting delay gear 121 becomes free and the inverting delay gear spring thereby extends so that the first inverting delay gear 121 approximately rotates once and returns to the initial state.

Next, the lift mechanisms are set at the first position to complete the preparations for the start of the backside recording (S22).

Here, a description will be given as to the reason for putting the passing guide 70 in the descending condition while performing the registration operation in the case of using the relatively thick recording paper 4. In the case of creating the loop with the relatively thick recording paper 4 just as in the case of the relatively thin recording paper 4 as in FIG. 22C, the recording paper 4 is conveyed along the pinch roller holder 23 even before reaching the nip portion because of its high rigidity. Thus, if an attempt is made to further carry the recording paper 4 having reached the nip portion and form the loop with it, there is already no space for forming the loop so that no loop can be formed. There are the cases where the registration cannot be well performed for that reason. This is the reason for putting the passing guide 70 in the descending condition while performing the registration operation in the case of using the relatively thick recording paper 4.

If no loop is formed on the recording paper 4, no sag can be made in the recording paper 4 held simultaneously between the first two-sided roller 108 and the paper feed roller 21. In the case where the mechanism such as the two-sided pendulum arm 117 is used as the drive mechanism of the rollers as in this embodiment, a time for swinging the two-sided pendulum arm 117 is required in a period from the reversal of the LF motor 26 in the step 20 to the normal rotation of the LF motor 26 in the step 21, in which period the first two-sided roller 108 and second two-sided roller 109 are stopping. As the paper feed roller 21 is directly connected to the LF motor 26 and has no such period for stopping, there arises a difference in the conveying speed of the recording paper.

If there is the sag in the recording paper 4, the difference in the conveying speed of the recording paper can be absorbed by eliminating the sag during the step 21. In the case where there is no sag, however, the difference in the conveying speed of the recording paper cannot be absorbed and there may arise a situation wherein, if the paper feed roller 21 side tries to forcedly carry the recording paper, it is not actually conveyed because the back of the recording paper 4 is held by the first two-sided roller 108. Thus, there are the cases where a conveyed amount of the backside end of the recording paper 4 goes wrong and a backside top margin becomes shorter than an assumed margin. To dissolve the above situation, the passing guide 70 is put in the descending position to take a sufficient clearance with the pinch roller holder 23 in the height direction so as to secure the space for forming the loop. It is thereby possible to perform a good registration operation even in the case of using the relatively thick recording paper of high rigidity.

Here, a description will be given as to another method of the registration operation. This registration operation is performed by a conveying apparatus including a pair of feed rollers 21 and 22 including the paper feed roller 21 and the pinch roller 22 press-contacted to the paper feed roller 21 and the two-sided rollers 108 and 109 which are upstream-side conveying rollers placed on an upstream side of the normal conveying direction of the recording paper 4 by the pair of feed rollers 21 and 22.

First, in the step 16, the backside end of the recording paper 4 is conveyed until it comes to a location a little before the PE sensor 67 when the LF motor 26 is reversed to carry the recording paper 4 in the direction of the paper feed roller 21 by means of the two-sided rollers 108 and 109. Next, the lift mechanisms are operated to move on to the third position. The pinch roller 22 is thereby released from the paper feed roller 21. Next, the LF motor 26 is reversed to carry the recording paper 4 in the direction of the paper feed roller 21 by means of the two-sided rollers 108 and 109. And the backside end of the recording paper 4 is detected by the PE sensor 67. If the backside end is detected, the recording paper 4 is conveyed by the two-sided rollers 108 and 109 over a distance a little longer than the distance from a backside end position detected by the PE sensor 67 to the paper feed roller 21. At this time, the paper feed roller 21 is rotating in the direction for returning the recording paper 4, but the pinch roller 22 is released from the paper feed roller 21. Therefore, the backside end of the recording paper 4 is conveyed further downstream than the nip portion between the paper feed roller 21 and pinch roller 22.

Next, the lift mechanisms are operated to move on to the first position. The pinch roller 22 is thereby press-contacted to the paper feed roller 21 so as to hold the end of the recording paper 4. Next, the paper feed roller 21 is rotated in the direction for conveying the recording paper 4 to the upstream side of the normal conveying direction (first direction) so as to eject the backside end of the recording paper 4 from the nip portion between the paper feed roller 21 and pinch roller 22. In this case, the two-sided rollers 108 and 109 have the driving interrupted due to the configuration of the drive mechanism. Therefore, the backside end of the recording paper 4 is sent at the direction of the paper feed roller 21. As the end of the recording paper 4 is remaining in the nip portion, the loop is formed at the end of the recording paper 4 so as to complete the registration operation.

Thereafter, the paper feed roller 21 is rotated in a second direction opposite to the first direction to carry the recording paper 4 in the normal direction and hold the recording paper 4 again at the nip portion between the pair of paper feed rollers 21 and 22. And the recording paper 4 is conveyed by the pair of paper feed rollers 21 and 22 so as to record on the backside of the recording paper 4.

The aforementioned two registration operations are performed by hitting the nip portion between the paper feed roller 21 and pinch roller 22 with the end of the recording paper 4. As opposed to them, this registration operation has an advantage that the end of the recording paper 4 is not easily rolled because, according to it, the pinch roller 22 is press-contacted after the end of the recording paper 4 passes the nip portion of the released pinch roller 22 and the end of the recording paper 4 is held and then ejected to the nip portion.

The registration operations including the aforementioned ones are not limited to once but may be performed twice or more in a row. For instance, it is also possible to carry the recording paper 4 first in the normal conveying direction by means of the two-sided rollers 108 and 109 which are the upstream-side conveying rollers, and cause the recording paper 4 to contact the nip portion between the paper feed roller 21 and pinch roller 22 rotating in the first direction for conveying the recording paper 4 to the upstream side until a predetermined amount of flexure occurs to the recording paper 4 as the first registration operation, and then rotate the paper feed roller 21 by a predetermined amount in the second direction to send the end of the recording paper 4 to the downstream side once and then rotate the paper feed roller 21 by a predetermined amount in the first direction (direction for sending the recording paper 4 to the upstream side) and eject the recording paper 4 from the nip portion between the paper feed roller 21 and pinch roller 22 so as to perform the second registration operation.

Next, the recording operation on the backside of the recording paper 4 is performed (S23). In this case, there is a possibility that the recording paper 4 curls upward due to ink overstruck for the right face recording to cause the backside of the recording paper 4 to contact the carriage 13 or contact the spur base 34 and cause the jam. For that reason, the recording is performed in an end area of the recording paper 4 by the record head 11 while conveying the recording paper 4 with the paper feed roller 21, and when the end of the recording paper 4 gets stuck in between the first spur row 32 and the first ejection roller 30 thereafter, the carriage 13 is stopped at the position opposed to one of the ends of the recording paper 4 so as to curb the floating of the end of the recording paper 4. This control operation of the carriage 13 against the curling of the recording paper 4 may also be performed on the right face recording of the recording paper.

During the recording operation on the backside, most of the backside end of the recording paper 4 is still held by the first two-sided roller 108. If the rotation of the first two-sided roller 108 is stopped as-is, it becomes the load for pulling the recording paper 4 backward possibly deteriorating conveying accuracy of the recording paper 4. Therefore, it is not desirable to stop the rotation of the first two-sided roller 108 as-is. Thus, the drive of the first two-sided roller 108 is continued at least while the backside end of the recording paper 4 is held by the first two-sided roller 108. The roller drive mechanism in this case is in the state shown in FIG. 20D.

FIG. 20D is a schematic side sectional view showing the operating state of the roller drive mechanism of the sheet inverting portion 2 while the LF motor 26 is rotating in the normal direction after the inverting operation of the recording paper 4. If the LF motor 26 rotates in the normal direction from the state in FIG. 20C, the two-sided pendulum arm 117 swings in the arrow a direction in FIG. 20D. At this time, the stop arm 127 is swinging in the arrow h direction in FIG. 20C. And even if the two-sided pendulum arm 117 swings in the arrow a direction in FIG. 20D, the two-sided pendulum arm spring 132 does not contact the stop arm 127 so that the first two-sided planet gear 118 engages with the two-sided roller idler gear 124 to transmit the driving force.

Thereafter, if the LF motor 26 continues to rotate in the normal direction, the follower pin 127*a* is led by the spiral groove gear 120 and moves to the inner circumference thereof, and the stop arm 127 swings in the arrow g direction in FIG. 20D. The stop arm 127 contacts the two-sided pendulum arm spring 132 halfway through swinging and deforms the two-sided pendulum arm spring 132. A reaction force due to the deformation of the two-sided pendulum arm spring 132 exerts a force to cause the two-sided pendulum arm 117 to swing in the arrow b direction in FIG. 20B. During the drive transmission, however, the force for mutually engaging the tooth planes between the first two-sided planet gear 118 and the two-sided roller idler gear 124 is stronger so that the drive continues without disengaging the first two-sided planet gear 118 and two-sided roller idler gear 124. FIG. 20D shows this state. Even in the case of performing the intermittent driving accompanied by rotation and stop as previously mentioned, the tooth planes are engaged and so the first two-sided planet gear 118 and two-sided roller idler gear 124 will not go out of the engagement.

If the backside recording operation of the recording paper 4 is further continued to rotate the LF motor 26 in the normal direction, the follower pin 127*a* reaches the innermost circumference of the spiral groove gear 120. The two-sided roller drive mechanism at this time is in the state shown in FIG. 20E. At this time, the two-sided pendulum arm spring 132 is in the most deformed state. Nevertheless, the gears will not be disengaged as long as the LF motor 26 is rotated in the normal direction because the load of the two-sided pendulum arm spring 132 is set so that the force for the tooth planes to be engaged becomes larger than the force for swinging the two-sided pendulum arm 117.

If the above backside recording operation of the recording paper 4 is finished, an ejecting operation is performed next to eject the recording paper 4 on a catch tray not shown (S24). In the ejecting operation, the LF motor 26 continues to rotate in the normal direction so as to carry the recording paper 4 to the outside of the recording unit body 1 with the second ejection roller 31.

Next, a backside end absolute position is checked (S25). This is because, when using the recording paper 4 which is relatively short, the follower pin 127*a* may not reach the innermost circumference of the spiral groove gear 120. Even in that case, the LF motor 26 is rotated for a predetermined length so that the follower pin 127*a* certainly reaches the innermost circumference of the spiral groove gear 120 when the backside recording operation of the recording paper 4 is finished.

Next, the two-sided roller drive mechanism is initialized (S26). As previously mentioned, the force charged by the two-sided pendulum arm spring 132 is held by the engagement of the first two-sided planet gear 118 and two-sided roller idler gear 124. Therefore, they will be disengaged just by slightly reversing the LF motor 26. To be more specific, if the LF motor 26 is reversed, the two-sided pendulum arm 117 swings in the arrow b direction in FIG. 20B so that the first two-sided planet gear 118 and two-sided roller idler gear 124 get disengaged and the two-sided pendulum arm 117 swings in the arrow b direction at a dash with the force charged by the two-sided pendulum arm spring 132 to return to its original state. The two-sided roller drive mechanism at this time is in the state shown in FIG. 20F.

The two-sided pendulum arm spring 132 has returned to its original position in this state. Therefore, in the case where the LF motor 26 rotates in the normal direction from here, the two-sided pendulum arm 117 swings in the arrow a direction in FIG. 22A. As the follower pin 127*a* is in the neighborhood of the innermost circumference of the spiral groove gear 120, the two-sided pendulum arm spring 132 contacts the stop arm 127 so that the first two-sided planet gear 118 cannot engage with the two-sided roller idler gear 124. Even if the LF motor 26 is further rotated in the normal direction, the follower pin 127*a* keeps rotating in the innermost circumference of the spiral groove gear 120, and so the two-sided rollers 108 and 109 will not be driven. As the first inverting delay gear 121 is initialized in the step 19 or 21 as previously mentioned, the step 26 concludes initialization of the entire two-sided roller drive mechanism.

The automatic two-sided recording operation is finished as above. The same sequences should be repeated in the case of continuously performing the automatic two-sided recording operation.

According to this embodiment, there is an elastic contact relationship between the two-sided pendulum arm 117 and the stop arm 127 due to the action of the two-sided pendulum arm spring 132. However, the purpose of the present invention is not limited thereto, but may be constituted as follows.

FIGS. 24A to 24E are schematic perspective views showing the operating states of the roller drive mechanism of the sheet inverting portion 2 as in FIGS. 20A to 20F. The two-sided pendulum arm 117 in FIGS. 24A to 24E has an arm of which elasticity is relatively low, where the arm and the stop arm 127 are in a contactable relationship. Hereafter, the operation in this configuration will be briefly described.

Figure 24A:
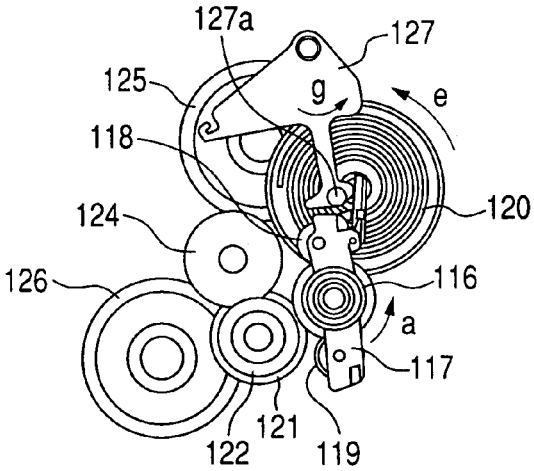
FIGS. 24A, 24B, 24C, 24D and 24E are schematic perspective views showing the operating states of the roller and so on of the sheet inverting portion as in FIGS. 20A to 20F.
Figure 24D:
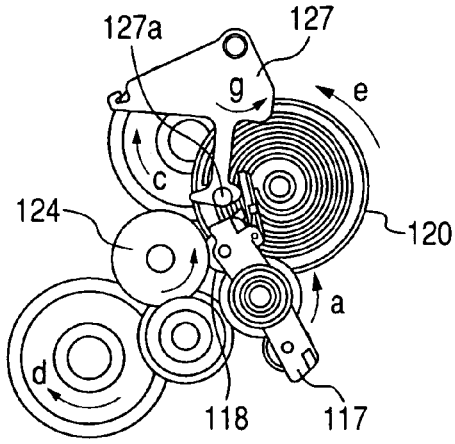
Figure 24B:
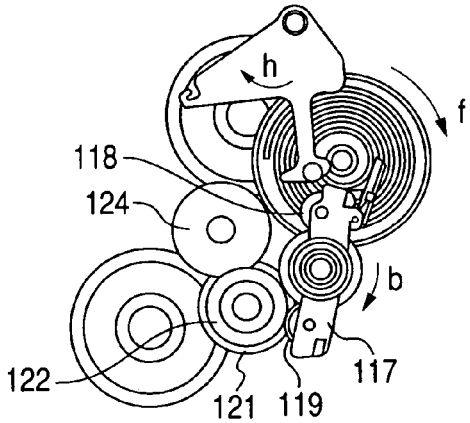
Figure 24E:
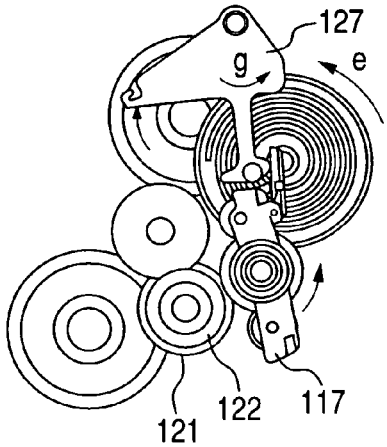
Figure 24C:
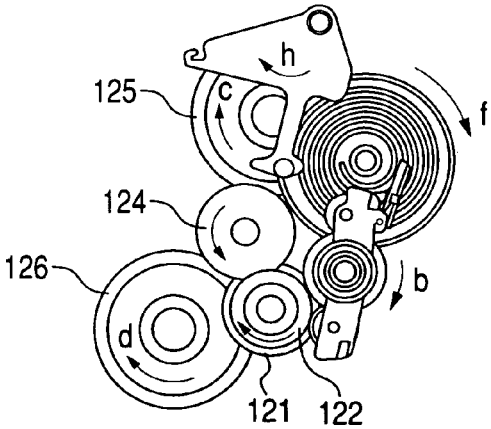

The operation in FIGS. 24A to 24C is the same as that in FIGS. 20A to 20C, and so a description thereof will be omitted here.

FIG. 24D shows the state in which the stop arm 127 has moved in the inner circumference direction of the spiral groove gear 120 and is in contact with the arm of the two-sided pendulum arm 117. As the arm of the two-sided pendulum arm 117 is not so elastic, the force for rotating the two-sided pendulum arm 117 in the arrow b direction in FIG. 24B is exerted if pushed by the stop arm 127. That force works in the direction for disengaging the first two-sided planet gear 118 from the two-sided roller idler gear 124. The force for disengaging them matches with the pressure exerted between the tooth planes of the first two-sided planet gear 118 and the two-sided roller idler gear 124 and elasticity and slippage force of the tooth planes of the gears. However, the force for disengaging them becomes stronger over time as the follower pin 127*a* moves to the inner circumference, and overcomes the force between the tooth planes so as to disengage the first two-sided planet gear 118 from the two-sided roller idler gear 124. On having them disengaged, the two-sided rollers 108 and 109 stop the rotation. FIG. 24E shows this state.

As for the timing for stopping the rotation of the rollers, it is performed in the step 23 at an appropriate time after the backside end of the recording paper 4 passes the first two-sided roller 108. Even if the LF motor 26 rotates in the normal direction after disengagement of the gears, the stop arm 127 prevents the two-sided pendulum arm 117 from swinging in the arrow a direction in FIG. 24A. Therefore, the sheet inverting portion 2 is not driven until the LF motor 26 is reversed by the predetermined amount next. As described by referring to FIG. 20, the first inverting delay gear 121 is initialized in the step 19 or 21 so that the initialization of the roller drive mechanism of the sheet inverting portion 2 is completed at this point in time. Thus, it is possible to eliminate the load for rotating the two-sided rollers 108 and 109 during the backside recording operation so as to reduce the rotation load of the LF motor 26. The above is another example of the roller drive mechanism of the sheet inverting portion 2.

The above described the automatic two-sided recording operation according to the flowchart showing operation sequences.

As described above, the embodiments of the present invention are constituted, in the process of inverting the recording medium on the conveying route for inversion, to stand by, for a predetermined time, for the conveying of the recording medium in the state in which the end of the second face of the recording medium in the normal conveying direction is in the conveying route for inversion. Therefore, it is possible, while standing by for the conveying of the recording medium for the predetermined time, to positively curl the end of the second face of the recording medium in the normal conveying direction into a desired shape of a loop-like conveying route for inversion. For that reason, it is feasible to prevent the recording medium from improperly curling upward to contact the recording means or causing the jam thereof during the conveying due to the ink overstruck in the recording medium. It is also possible to prevent the recording medium from curling and causing the jam thereof during the conveying due to the conditions such as the kind of the recording medium and temperature and humidity of the environment for performing the recording operation.

It is also possible to curb the floating of the recording medium on recording on the second face without reducing a discharge rate of the ink to the recording medium on recording on a first face so as to record on both faces of the recording medium without deteriorating a recording quality.

It is no longer necessary to mount a paper holding member on the platen for the sake of keeping the recording medium from floating when recording on its second face. Therefore, on holding right and left rims of the recording paper, the paper holding member no longer interferes to render the frameless recording infeasible or take a conspicuously longer time for the frameless recording.

This application claims priority from Japanese Patent Application No. 2003-306416 filed Aug. 29, 2003, which is hereby incorporated by reference herein.

What is claimed is:

1. A recording apparatus for recording on both faces of a recording medium with a record head, including:

a conveying roller provided upstream of said recording head to convey the recording medium;

a first inverting roller for inverting the recording medium on which a first face has been recorded by said recording head;

a first pinch roller rotatingly driven by said first inverting roller;

a second inverting roller provided downstream of said first inverting roller, for inverting the recording medium;

a second pinch roller rotatingly driven by said second inverting roller; and control means for stopping the conveying of the recording medium in a state of holding a leading edge of the recording medium at a nip portion between the second inverting roller and the second pinch roller.

2. The recording apparatus according to claim 1, wherein the record head is an ink-jet record head for recording by discharging ink on the recording medium, and said control means changes a time for stopping the conveying of the recording medium according to an amount of the ink discharged in a unit time on the first face.

3. The recording apparatus according to claim 1, wherein said control means stops conveying of the recording medium in the case where rigidity of the recording medium is lower than a predetermined value.

4. The recording apparatus according to claim 3, wherein the conveying of the recording medium by said control means is stopped in the case where the stiffness according to a rigidity meter of Gurley method is smaller than 9.807 mN.

5. The recording apparatus according to claim 1, wherein the conveying of the recording medium by said control means is stopped in the case where the recording is performed in a predetermined distance from a back end of the first face.

6. The recording apparatus according to claim 5, wherein the predetermined distance is 4 inches.

7. A recording apparatus for recording both-faces of a recording medium with a recording head, comprising:

a conveying roller provided upstream of said recording head to convey the recording medium;

a platen for supporting the recording medium at a position opposite to the recording head;

an inverting portion for inverting the recording medium; and a control means for stopping the conveying of the recording medium in said inverting portion so as to curl a leading edge of the recording medium in a direction back away from the recording head.

8. The recording apparatus according to claim 7, wherein the record head is an ink-jet record head for recording by discharging ink on the recording medium, and said control means changes a time for stopping the conveying of the recording medium according to an amount of the ink discharged in a unit time on the first face.

9. The recording apparatus according to claim 7, wherein said control means stops conveying of the recording medium in the case where rigidity of the recording medium is lower than a predetermined value.

10. The recording apparatus according to claim 9, wherein the conveying of the recording medium by said control means is stopped in the case where the stiffness according to a rigidity meter of Gurley method is smaller than 9.807 mN.

11. The recording apparatus according to claim 7, wherein the conveying of the recording medium by said control means is stopped in the case where the recording is performed in a predetermined distance from a back end of the first face.

12. The recording apparatus according to claim 11, wherein the predetermined distance is 4 inches.

* * * * *

UNITED STATES PATENT AND TRADEMARK OFFICE

CERTIFICATE OF CORRECTION

PATENT NO. : 7,063,417 B2
APPLICATION NO. : 10/928169
DATED : June 20, 2006
INVENTOR(S) : Koya Iwakura et al.

It is certified that error appears in the above-identified patent and that said Letters Patent is hereby corrected as shown below:

ON THE TITLE PAGE, AT ITEM (57), Abstract:
Line 7, “in” should read --of--.

COLUMN 1:
Line 49, “in” should be deleted.
Line 58, “discharger” should read --discharge--.

COLUMN 2:
Line 4, “conveyedconveyed” should read --conveyed--.
Line 39, “medium loaded” should read --medium is loaded--.

COLUMN 5:
Line 59, “IF” should read --If--.

COLUMN 6:
Line 13, “the” should read --The--.

COLUMN 11:
Line 12, “held the” should read --held at the--.

COLUMN 15:
Line 62, “horaizontal.” should read --horizontal.--.

COLUMN 18:
Line 22, “horaizontal” should read --horizontal--.

COLUMN 19:
Line 23, “As the” should read --The--.

COLUMN 23:
Line 5, “conveysconveys” should read --conveys--.

COLUMN 24:
Line 37, “conveysconveys” should read --conveys--.

COLUMN 26:
Line 62, “therefore,” should read --Therefore,--.

COLUMN 27:
Line 12, “sate.” should read --state.--.

UNITED STATES PATENT AND TRADEMARK OFFICE

CERTIFICATE OF CORRECTION

PATENT NO. : 7,063,417 B2
APPLICATION NO. : 10/928169
DATED : June 20, 2006
INVENTOR(S) : Koya Iwakura et al.

It is certified that error appears in the above-identified patent and that said Letters Patent is hereby corrected as shown below:

COLUMN 30:
Line 1, “till” should read --until--.
Line 10, “compresses” should read --compressed--.

COLUMN 35:
Line 37, “recording” should read --record--.
Line 40, “record-” should read --record--.
Line 41, “ing” should be deleted.

COLUMN 36:
Line 20, “both-faces” should read --both faces--.
Line 21, “recording” (second occurrence) should read --record--.
Line 22, “recording” should read --record--.
Line 25, “recording” should read --record--.
Line 31, “recording” should read --record--.

Signed and Sealed this

Tenth Day of April, 2007

JON W. DUDAS
*Director of the United States Patent and Trademark Office*